US011676525B1

(12) United States Patent
Waller

(10) Patent No.: US 11,676,525 B1
(45) Date of Patent: Jun. 13, 2023

(54) DISPLAY PIXEL DESIGN AND CONTROL FOR LOWER POWER AND HIGHER BIT DEPTH

(71) Applicant: Syndiant, Inc., Dallas, TX (US)

(72) Inventor: Craig Michael Waller, Dallas, TX (US)

(73) Assignees: Syndiant, Inc., Dallas, TX (US); XDMicro(Zhongshan) Optoelectronics Semiconductor Co. LTD, Dallas, TX (US)

( * ) Notice: Subject to any disclaimer, the term of this patent is extended or adjusted under 35 U.S.C. 154(b) by 0 days.

(21) Appl. No.: 17/971,561

(22) Filed: Oct. 22, 2022

Related U.S. Application Data

(63) Continuation of application No. 17/587,433, filed on Jan. 28, 2022, now Pat. No. 11,527,189.

(51) Int. Cl.
*G09G 3/20* (2006.01)

(52) U.S. Cl.
CPC ..... *G09G 3/20* (2013.01); *G09G 2300/0814* (2013.01); *G09G 2310/0243* (2013.01); *G09G 2330/021* (2013.01)

(58) Field of Classification Search
CPC ..... G09G 3/20; G09G 2300/0814; G09G 2310/0243; G09G 2330/021
See application file for complete search history.

(56) References Cited

U.S. PATENT DOCUMENTS

2019/0005902 A1* 1/2019 Chen ..... G09G 3/3648
2019/0006390 A1* 1/2019 Park ..... H01L 27/1222

* cited by examiner

*Primary Examiner* — Sejoon Ahn
(74) *Attorney, Agent, or Firm* — Edward S. Mao

(57) ABSTRACT

Display Pixel Design and Control for Lower Power and Higher Bit Depth Craig Michael Waller A method to generate pixel control signals more rapidly and with less overhead is disclosed. The method generates pixel control signals for a first block of pixels having a first first-block pixel and a second first-block pixel and a second block of pixels having a first first-block pixel and a second second-block pixel. A first-block base control signal that is shared by the first block of pixels is generated. A first first-block sharpening control signal for the first first-block pixel is generated and a first second-second-block sharpening control signal for the first second-block pixel is generated. The first first-block pixel control signal is generated using the first first-block sharpening signal and the first-block base control signal. The first second-block pixel control signal is generated using the first second-block sharpening signal and the second-block base control signal.

20 Claims, 26 Drawing Sheets

DISPLAY PIXEL DESIGN AND CONTROL FOR LOWER POWER AND HIGHER BIT DEPTH

BACKGROUND OF THE INVENTION

Field of the Invention

The present invention relates to display technology. More specifically, the present invention relates to digital backplanes that control light modulating elements, spatial light modulators and light sources.

Discussion of Related Art

Micro-displays typically include light modulating backplane and a light modulating unit or a light emitting unit. Light modulating units include such technologies as liquid crystal on silicon (LCOS) and digital micro mirrors devices (DMD). Light emitting units include technologies such as Organic light emitting diodes (OLED) and Micro LEDs (μLED). The technology used in such micro displays can also be used to make larger display units.

FIG. 1 shows a simplified architecture of a display 100 having a controller 110 and a display panel 150. Controller 110 includes a double frame buffer 112 and logic block 118. Display panel 150 includes pixel array 152, pixel processors 155, and field buffer 158. A video stream VS is received by controller 110 and stored in double frame buffer 112 by logic block 118. Double frame buffer 112 can load one incoming frame while storing the previous frame that is being displayed by display panel 150. Logic block 118 controls double frame buffer 112 to store image frames and to transfer image fields to field buffer 158. As used herein, an image field is a component of an image frame. Typically, an image frame can be separated into three image fields most commonly a red image field, a green image field, and a blue image field. Generally, each pixel of the image frame will have an 8 bit red component, an 8 bit green component, and an 8 bit blue component. Thus, each pixel of the image frame requires 24 bits of data, while each pixel of an image field requires 8 bits of data.

Display panel 150 uses a field-sequential color system (FSC) in which the different color image fields are displayed successively on pixel array 152 very rapidly. However the present invention is also applicable to other types of color display systems. Field-sequential color systems rely on the human vision system to fuse the successive image fields into a very close copy of the original image frame. Furthermore, display 150 uses a single control signal digital drive scheme for each pixel. Each pixel is either on (control signal at logic high) or off (control signal at logic low) at any point in time. Specifically, each field is displayed for a field time period FT; field time period FT has 256 possible update times for the pixel control signals. The brightness of each pixel for each color field is controlled by the duration the control signal is at logic high. Generally, each pixel has a memory cell that drives the pixel control signal. The memory cells are controlled by the pixel processors to generate the pixel control signals. Generally, pixel processors 155 include a pixel processor for each column of pixel array 152. At every pixel-update time, each of the pixel processors updates all the pixels in the associated column.

FIG. 2 illustrates three pixel control signals PCS_1, PCS_2, and PCS_3. Specifically pixel control signal PCS_1 controls a pixel at the maximum brightness and thus turns on (raised to logic high) at update time 0 (labeled UT_0 in FIG. 2) and stays on (at logic high) for the entire field time period FT. In some implementations display panel 150, pixel control signals are always turned off (lowered to logic low) at the end of field time period FT. While other implementations leave pixel control signals on if they are at maximum brightness. Pixel control signal PCS_2 is for a brightness value of 155, thus pixel control signal PCS_2 turns on (raised to logic high) at update time 0 (labeled UT_0 in FIG. 2) and stays on (at logic high) until update time 155 (labeled UT_155 in FIG. 2) when pixel control signal PCS_2 is turned off (lowered to logic low). Pixel control signal PCS_3 is for a brightness value of 57, thus pixel control signal PCS_3 turns on (raised to logic high) at update time 0 (labeled UT_0 in FIG. 2) and stays on (at logic high) until update time 57 (labeled UT_57 in FIG. 2) when pixel control signal PCS_2 is turned off (lowered to logic low).

As the resolution of video systems has increased, a major issue of displays like display 100 is the large memory requirement of the double frame buffer 112 and field buffer 158. Furthermore, the time required to transfer image fields between double frame buffer 112 and field buffer 158 may decrease the performance of the display for higher resolutions. Compression schemes can be used to address these issues. FIG. 3 is a block diagram of a compression scheme that can be used with display 100. As shown in FIG. 3, each image frame I_Fr is fed to a low pass filter 310 and a subtractor 320. Low pass filter 310 creates a low frequency image L_F_I from image frame I_Fr. Subtractor 320 subtracts low frequency image L_F_I from image frame I_Fr to create a high frequency image H_F_I. Because high frequency image H_F_I is created by a subtracting operation, high frequency image H_F_I can have positive and negative values and thus would require a sign bit for each of the eight bit color components, thus high frequency image H_F_I requires 27 bits (9 bits for each color component) per pixel. However, the human visual system is insensitive to chrominance information at high spatial frequencies. Thus, image compression is achieved with luminance converter 340 which converts high frequency image H_F_I, into a luminance image LUM_I. Luminance images are often referred to as a grayscale images. Thus, the 3 color image fields, each of which required 9 bits per pixel (for a total of 27 bits per pixel) is reduced to a single luminance based image requiring 9 bits per pixel. Further compression can be achieved using quantization to take advantage of a well known phenomenon known as masking. In high frequency luma images created from an input image, flat or smooth (slowly varying) regions of the input image will produce values of high frequency luma difference components that are small or zero in magnitude. However, edges or textured regions of the input image will produce larger magnitudes in the high frequency image. In general, larger quantization errors are acceptable for larger changes in high frequency luma components because those errors are less detectable in the edges or textures of the input image. Accordingly, a log scale quantization of a high frequency luminance difference-image introduces image errors that can be imperceptible. Thus as shown in FIG. 3, luminance image LUM_I is processed by quantizer 360 to form a sharpener image SH, which is a quantized version of luminance image LUM_I. Specifically, each pixel of luminance image LUM_I, is quantized to a value in the set of {−192, −96, −48, −24, −12, −6, −3, −1, 0, 2, 5, 11, 23, 47, 95, and 1911. Because 16 values are used by quantizer 360, only 4 bits are needed for each pixel of sharpener image SH. Different values and different sized sets can be used in different embodiments of quantizer 360.

Low frequency image L_F_I is reduced by decimator 330 into a base image B. Decimator 330 subsamples each image field of low frequency image L_F_I, independently to create a base image B. Base image B, is a quarter of the size of low frequency image L_F_I. Specifically, each 2×2 pixel block of low frequency image L_F_I is replaced by a single pixel in base image B. The pixel in base image B is shown as a simple average of the 2×2 pixel block. However, other methods to calculate the pixel in base image B may be used. Thus, base image B is only a quarter of the size of low frequency image L_F_I. Thus base image B when expanded to the size of input image frame I_FR, would only use 6 bits per pixel instead of 24 bits per pixel, because the pixels in each 2×2 pixel block would be identical and therefore be equal to one fourth of the original value.

A very close approximation of input image frame I_Fr can be created by adding base image B and sharpener image SH. As explained above, Base image B uses equivalently 6 bits per pixel and sharpener image SH uses 4 bits per pixels. Thus taken together Base image B and sharpener image SH uses a combined 10 bits per pixel instead of the original 24 bits per pixel of input image frame I_Fr. FIG. 4 illustrates the method to combine base image B and sharpener image SH to form a decompressed image D_IMG. For clarity, a base image pixel B_P(X, Y) includes a red component B_R(X, Y), a green component B_G(X, y), and a blue component B_B(X, Y). A decompressed image pixel D_P(I, J) has a red component D_R(I, J), a green component D_G(I, j), and a blue component D_B(I, J). Because sharpener SH, is a luminance image, each sharpener pixel S_P(M, N) is a single component (which as explained above is a 4 bit value that represents one of 16 quantized value)

In FIG. 4, base image pixel B_P(0,0) (not specifically labeled in FIG. 4) includes a red component B_R(0, 0) with a value of 149, a green component B_G(0, 0) with a value of 191, and a blue component B_B(0, 0) with a value of 85. Sharpener pixel S_P(0, 0) has a quantized value of 0, sharpener pixel S_P(0, 1) has a quantized value of 95, sharpener pixel S_P(1, 0) has a quantized value of −96, and sharpener pixel S_P(1, 1) has a quantized value of 47.

As explained above decompressed image D_IMG is created by expanding base image B and adding sharpener SH. A base image pixel B_P(X, Y) is used to calculate decompressed image pixels D_P(2*X, 2*Y), D_P(2*X+1, 2*Y), D_P(2*X, 2*Y+1), and D_P(2*X+1, 2*X+1) with sharpener pixels SH_P(2*X, 2*Y), SH_P(2*X+1, 2*Y), SH_P(2*X, 2*Y+1), and SH_P(2*X+1, 2*X+1), respectively. A decompressed pixel D_P(I, J) has a red component D_R(I, J), a green component D_R(I, J), and a blue component D_B(I, J). Specifically, a red component D_R(I, J) of a decompressed pixel D_P(I, J) is equal to red component B_R(int (I/2), int(J/2)) of a base pixel B_P(int(I/2), int (J/2)) plus the quantized value of a sharpener pixel S_P(I, J), where I and J are integers. As used herein, "int(num)" is the integer function which returns the closest integer less than or equal to the number num. Thus for example if I equals 5 and J equals 10, red component D_R(5, 10) of decompressed pixel D_P(5, 10) is equal to red component B_R(2, 5) of a base pixel B_P(2, 5) plus the quantized value of sharpener pixel S_P(5, 10). Similarly, a green component D_G(I, J) of a decompressed pixel D_P(I, J) is equal to green component B_G(int(I/2), int(J/2)) of a base pixel B_P(int(I/2), int (J/2)) plus the quantized value of a sharpener pixel S_P(I, J). Furthermore, a blue component D_B(I, J) of a decompressed pixel D_P(I, J) is equal to blue component B_B(int(I/2), int(J/2)) of a base pixel B_P(int(I/2), int (J/2)) plus the quantized value of a sharpener pixel S_P(I, J). However, all values for the color components of decompressed image D_IMG are bounded by 0 and 255 inclusive. Thus negative values are set equal to 0 and values greater than 255 are set equal to 255.

Thus as shown in FIG. 4, red component D_R(0,0) is equal to red component B_R(0, 0) plus the quantized value of sharpener pixel S_P(0, 0) which is equal to 149+0, which equals to 149. Green component D_G(0, 0) is equal to green component B_G(0, 0) plus the quantized value of sharpener pixel S_P(0, 0), which is equal to 191+0, which equals 191. Blue component D_B(0, 0) is equal to blue component B_B(0, 0) plus the quantized value of sharpener pixel S_P(0, 0), which is equal to 85+0, which equals 85.

Red component D_R(0, 1) is equal to red component B_R(0, 0) plus the quantized value of sharpener pixel S_P(0, 1) which is equal to 149+−96, which equals to 53. Green component D_G(0, 1) is equal to green component B_G(0, 0) plus the quantized value of sharpener pixel S_P(0, 1), which is equal to 191+−96, which equals 95. Blue component D_B(0, 1) is equal to blue component B_B(0, 0) plus the quantized value of sharpener pixel S_P(0, 1), which is equal to 85+−96, which is less than zero and thus set equal to 0.

Red component D_R(1,0) is equal to red component B_R(0, 0) plus the quantized value of sharpener pixel S_P(1, 0) which is equal to 149+95, which equals to 244. Green component D_G(1, 0) is equal to green component B_G(0, 0) plus the quantized value of sharpener pixel S_P(1, 0), which is equal to 191+95, which is greater than 255 so would be set equal to 255. Blue component D_B(1, 1) is equal to blue component B_B(0, 0) plus the quantized value of sharpener pixel S_P(1, 0), which is equal to 85+95, which equals 180.

Red component D_R(1, 1) is equal to red component B_R(0, 0) plus the quantized value of sharpener pixel S_P(1, 1) which is equal to 149+47, which equals to 196. Green component D_G(1, 1) is equal to green component B_G(0, 0) plus the quantized value of sharpener pixel S_P(1, 1), which is equal to 191+47, which is equal to 238. Blue component D_B(1, 1) is equal to blue component B_B(0, 0) plus the quantized value of sharpener pixel S_P(1, 1), which is equal to 85+47, which equals 132. The other pixels of decompressed image are calculated in the same manner as described above.

As explained above, display 100 uses a field-sequential color scheme so that each color component is displayed in sequence. Each field is displayed in the same manner. Therefore, for brevity, only displaying the red field using the red color component of the decompressed video stream is explained in detail. Displaying the green field and blue field would be done in the same manner. Also as explained above, a single pixel control signal is used to control each pixel of pixel array 152. Each field is displayed for a field time period FT which is divided into 256 possible update times for the pixel control signals. The brightness of each pixel for each color field is controlled by the duration the pixel control signal is at logic high (also referred to be on). In conventional displays a single 1-bit memory cell is used for each pixel to drive the pixel control signal. One way to display decompressed image D_IMG is to calculate D_IMG as explained above and drive the pixel control signals as explained above with respect to FIG. 2 using the value of the color component of decompressed D_IMG. However, to do so would require including adders in pixel processors 155, which would increase the complexity of the pixel processors beyond simple comparators.

Another method is to indirectly add a base value B_V and quantized value QV from the sharpener via scheduling conditions which compare both the base value B_V and quantized value Q_V at update times and adjust the pixel control signal PCS value directly. In this method, if the quantized value QV of the sharpener is positive, the base value B_V is represented by a logic high pulse starting at update time UT_0 and ending at update time UT_BV. For example for a base value BV of 150, the pixel control signal would start at logic high at update time UT_0 and transition to logic low at update time UT_150. (In a similarly manner as described above with respect to FIG. 2). However for the decompressed image we need to add the quantized value QV of the sharpener pixel. If quantized value QV is positive, the brightness of the display pixel would increase relative to just the base value B_V. Thus, the pixel control signal would need to be at logic high for an additional quantized value QV update times. This additional quantized value QV update times can be added at the end of the field time period FT by unconditionally driving the pixel control signal to logic high quantized value QV update time before the end of field time period FT. Therefore, if quantized value QV of the sharpener pixel plus the base value B_V is greater than or equal to 255 the transition to logic low at update time UT_BV will be prevented so that the pixel control signal is at logic high during all of field time period FT. Consequently, at all update times that follow the first quantized add (largest add), both the base value B_V must be measured to determine if the pixel control signal should be turned off and the quantized value QV is measured to determine if the pixel control signal should supersede any base value and remain on.

Conversely, if quantized value QV of the sharpener pixel is negative, the pixel control signal should not be at logic high as long as indicated by base value B_V.

Accordingly, the logic high transition of the pixel control signal is unconditionally suspended until the magnitude (or absolute value) of quantized value QV has been met. Therefore, if quantized value QV of the sharpener pixel plus the base value B_V is less than or equal to 0, the transition to logic high will be prevented so that the pixel control signal is at logic low during all of field time period FT. Additionally, at each subtraction end time, in which the update time is equal to the quantized subtraction value, both the quantized value QV is measured to determine if the subtraction time has ended, and the pixel control signal should be allowed to turn on, and the base value B_V is measured to check if the subtraction value exceeds the base value B_V and override the pixel control signal being turned on to maintain an off position.

FIG. 5 illustrates the pixel control signals that correspond to the red field of decompressed image D_IMG of FIG. 4. Pixel Control signal PCS_R(0, 0) represents red component D_R(0, 0) of decompressed image D_IMG. Specifically, because the quantized value of sharpener pixel S_P(0, 0) is greater than or equal to zero and red component B_R(0,0) of base image B is greater than zero pixel control signal PCS_R(0,0) is driven to logic high at update time UT_0. Pixel control signal PCS_R(0,0) is driven to logic low at update time 149 because red component B_R(0, 0) has a value of 149. Pixel control signal PCS_R(0, 0) remains at logic low thru the rest of field time period FT because quantized value QV of sharpener pixel S_P(0, 0) is zero.

Pixel Control signal PCS_R(0, 1) represents red component D_R(0, 1) of decompressed image D_IMG. Specifically, because the quantized value of sharpener pixel S_P(0, 1) is less than zero the transition of pixel control signal PCS_R(0, 1) to logic high is delayed by the magnitude of quantized value QV of sharpener pixel S_P(0, 1). Because the magnitude of QV quantized value of sharpener pixel S_P(0, 1) is −96, pixel control signal PCS_R(0, 1) transitions to logic high at update time UT_96. Pixel control signal PCS_R(1,0) is driven to logic low at update time 149 because red component B_R(0, 0) has a value of 149. Pixel control signal PCS_R(0, 1) remains at logic low thru the rest of field time period FT. Because pixel control signal PCS_R (0, 1) remains at logic high between update time UT_96 and update time UT_149, pixel control signal PCS_R(0, 1) is at logic high for a total of 53 update times which is equal to the value of color component D_R(0, 1) of decompressed image D_IMG.

Pixel Control signal PCS_R(1, 0) represents red component D_R(1, 0) of decompressed image D_IMG. Specifically, because quantized value QV of sharpener pixel S_P(1, 0) is greater than zero and color component B_R(0, 0) is greater than zero pixel control signal PCS_R(1, 0) transitions to logic high at update time UT_0. Pixel control signal PCS_R(1, 0) is driven to logic low at update time 149 because red component B_R(0, 0) has a value of 149. Because the quantized value of sharpener pixel S_P(1,0) is positive pixel control signal is driven to logic high before the end of field time period FT. Specifically, the magnitude of the quantized value of sharpener pixel S_P(1, 0) is 95, therefore pixel control signal PCS_R(1, 0) transitions 95 update times before the end of field time period FT. As explained above there are 256 update times (i.e. update time UT_0 to UT_255) in field time period FT. Therefore, pixel control signal PCS_R(1, 0) transitions to logic high at update time UT_160 and remains at logic high for the rest of field time period FT. Because pixel control signal PCS_R(1, 0) is at logic high between update time UT_0 and update time UT_149 as well as between update time UT_160 and update time UT_255, pixel control signal PCS_R(0, 1) is at logic high for a total of 244 update times which is equal to the value of color component D_R(1, 0) of decompressed image D_IMG.

Pixel Control signal PCS_R(1, 1) represents red component D_R(1, 1) of decompressed image D_IMG. Specifically, because the quantized value of sharpener pixel S_P(1, 1) is greater than zero and color component B_R(0, 0) is greater than zero, pixel control signal PCS_R(1, 0) transitions to logic high at update time UT_0. Pixel control signal PCS_R(1, 1) is driven to logic low at update time 149 because red component B_R(0, 0) has a value of 149. Because quantized value QV of sharpener pixel S_P(1, 1) is positive pixel control signal is driven to logic high before the end of field time period FT. Specifically, the magnitude of the quantized value of sharpener pixel S_P(1, 1) is 47, therefore pixel control signal PCS_R(1, 1) transitions 47 update times before the end of field time period FT. As explained above there are 256 update times (i.e. update time UT_0 to UT 255) in field time period FT. Therefore pixel control signal PCS_R(1, 1) transitions to logic high at update time UT_208 and remains at logic high for the rest of field time period FT. Because pixel control signal PCS_R(1, 1) is at logic high between update time UT_0 and update time UT_149 as well as between update time UT_208 and update time UT_255, pixel control signal PCS_R(1, 1) is at logic high for a total of 196 update times which is equal to the value of color component D_R(1, 1) of decompressed image D_IMG.

The process described above to generate pixel control signals is used for each pixel of pixel array 152. A one bit memory cell is used to store a pixel control signal for each pixel of pixel array 152. The pixel control signals are controlled by pixel processors 155, which include a pixel processor for each column of pixel array 152. At every pixel-update time, each of the pixel processors must determine whether to cause a logic transition in the memory cell of each of the pixels in the associated column. At the end of a field time period FT, the next color field is displayed in the same manner. Each color field should be displayed multiple times for each frame of the video stream.

Common ways to improve video quality is to increase display resolution (i.e. increasing the number of pixels), increasing bit depth, increasing scan rates, and increasing frame update rates. Increasing display resolution increases the workload of each pixel processor and the power consumed since there are more pixels per columns that need to be controlled by each pixel processor. In addition, increasing frame rates reduces the field time and thus the pixel update times which decreases the time each pixel control signal can be updated. Hence there is a need for a method and system to more quickly update pixel control signals to support higher resolution, higher frame rates, and higher bit depths.

SUMMARY

Accordingly, the present invention provides a novel method to generate pixel control signal more rapidly and with less overhead. A display system generates pixel control signals for a block of pixels having a first pixel and a second pixel. A base control signal that is shared by the block of pixels is generated. A first sharpening control signal for the first pixel is generated and a second sharpening control signal for the second pixel is generated. The first pixel control signal is generated using the first sharpening signal and the base control signal. The second pixel control signal is generated using the second sharpening signal and the base control signal. The base control signal is stored in a first memory cell; the first sharpener control signal is stored in a second memory cell; and the second sharpener control signal is stored in a third memory cell. Specifically in one embodiment of the present invention, a first inverted sharpener sign bit signal is generated. The base control signal is selected as the first pixel control signal when the first sharpener control signal is in a first logic state and the first inverted sharpener sign bit signal is selected as the first pixel control signal when the fist sharpener control signal is in a second logic state.

In another embodiment of the present invention, The method also generates an inverted base control signal, a global input signal, a global control signal, and a sharpener correction signal. The sharpener correction signal is generated by selecting the inverted base control signal as the sharpener correction signal when the global control signal is in a first logic state and selecting the global input signal as the sharpener control signal when the global control signal is in a second logic state. The first pixel control signal is generated by selecting the base control signal as the first pixel control signal when the first sharpener control signal is in a first logic state and selecting the sharpener correction signal as the first pixel control signal when the first sharpener control signal is in the second logic state.

The present invention will be more fully understood in view of the following description and drawings.

DETAILED DESCRIPTION

As explained above, increasing the resolution, bit-depth, scan rates, and frame rates of displays can increase the quality of the displays. To support the higher resolution and frame rates requires a way to generate pixel control signals more rapidly. The present invention use a variety of novel techniques to reduce the area and processing requirements of the pixel processor to allow each pixel processor to handle more pixels and to process each pixel more rapidly which allows displays to have higher resolutions and faster frame rates.

Figure 5:
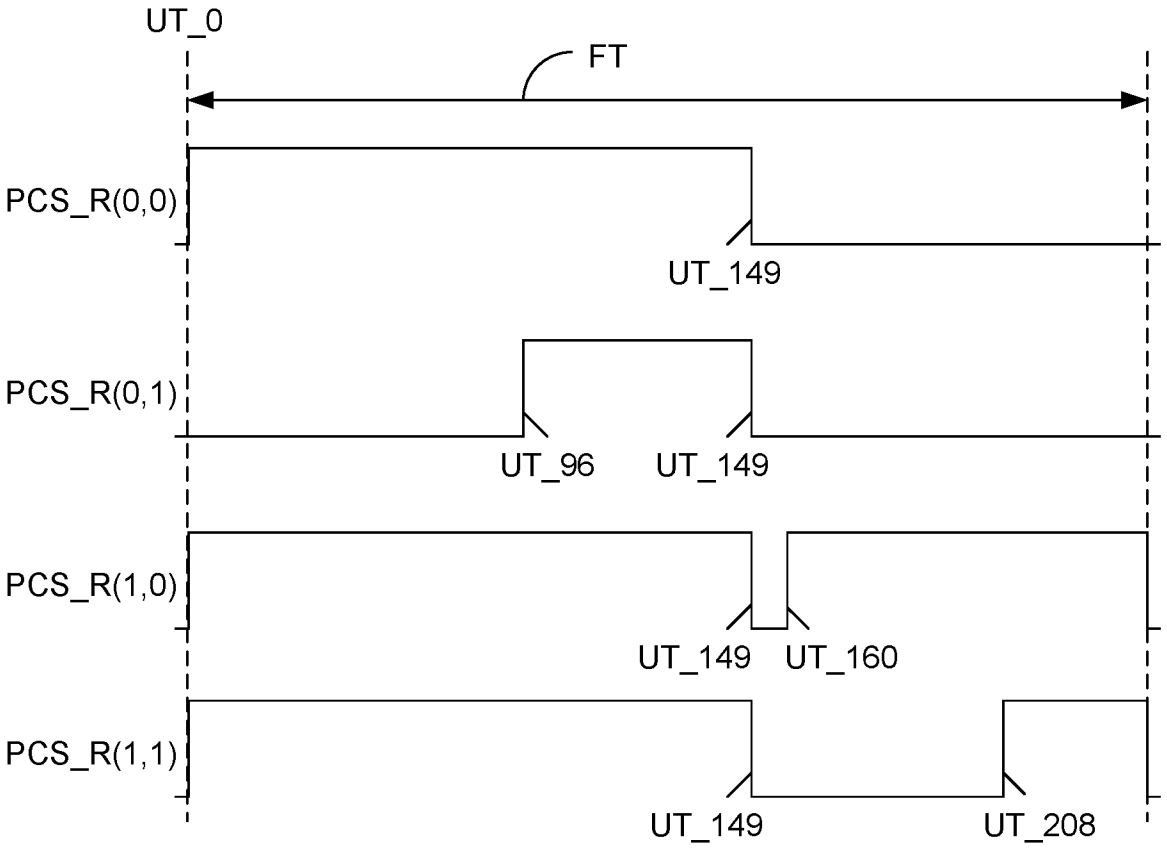
FIG. 5 (Prior Art)
FIG. 5 illustrates pixel control system used in a conventional display system.
Figure 6A:
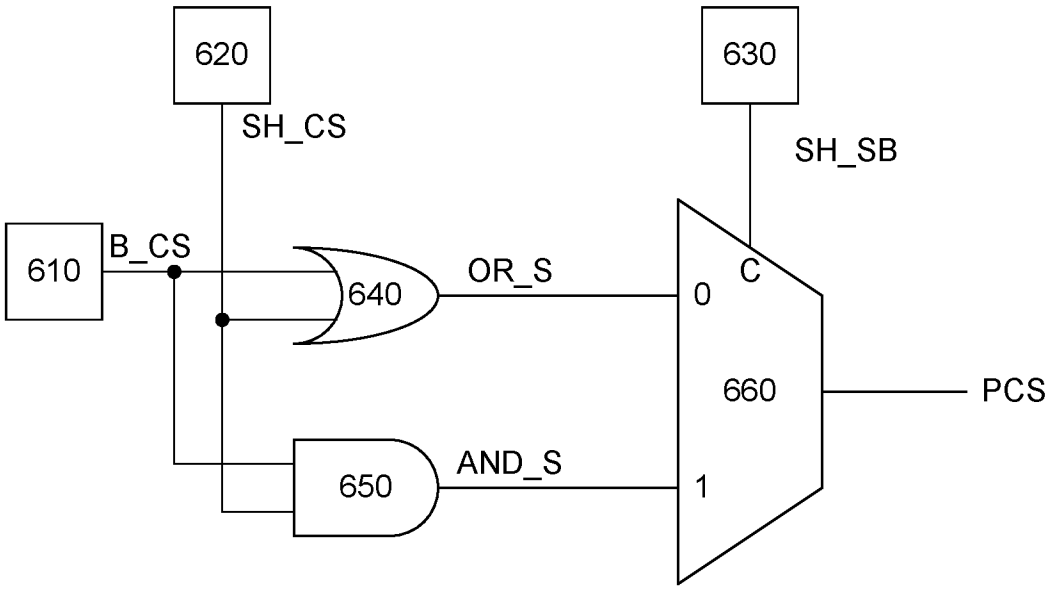
FIG. 6A is a schematic diagram of a novel system to generate pixel control signals in accordance with one embodiment of the present invention.

FIG. 6A is a novel circuit to generate a pixel control signal for use in displays using a single control signal digital drive scheme for each pixel. Rather than using a single memory bit for the pixel control signal, the circuit of FIG. 6A uses three memory bits. Although using additional memory bits for each pixel control signal would seem to increase the processing load on each pixel processor compared to a single memory bit, the present invention manages to reduce the processing load with the additional memory bits as explained below. The circuit of FIG. 6A can be used for displays using the compression scheme described above with respect to FIGS. 3-5. Thus, the description of FIG. 6A assumes that the circuit of FIG. 6A is used to drive a color component D_C(X, Y) of a pixel D_P(X, Y) of the decompressed image. The color components are usually red, green, or blue, but some embodiments of the invention may use other color components and even other color schemes. Color component D_C(X, Y) is equal to color component B_C(int(X/2), int(Y/2)) of a pixel B_P(int(X/2), int(Y/2)) of base image B plus a quantized value QV of sharpener pixel S_P(X, Y). The signals generated by the circuits of FIG. 6A are shown in FIGS. 7A and 7B.

Figure 7A:
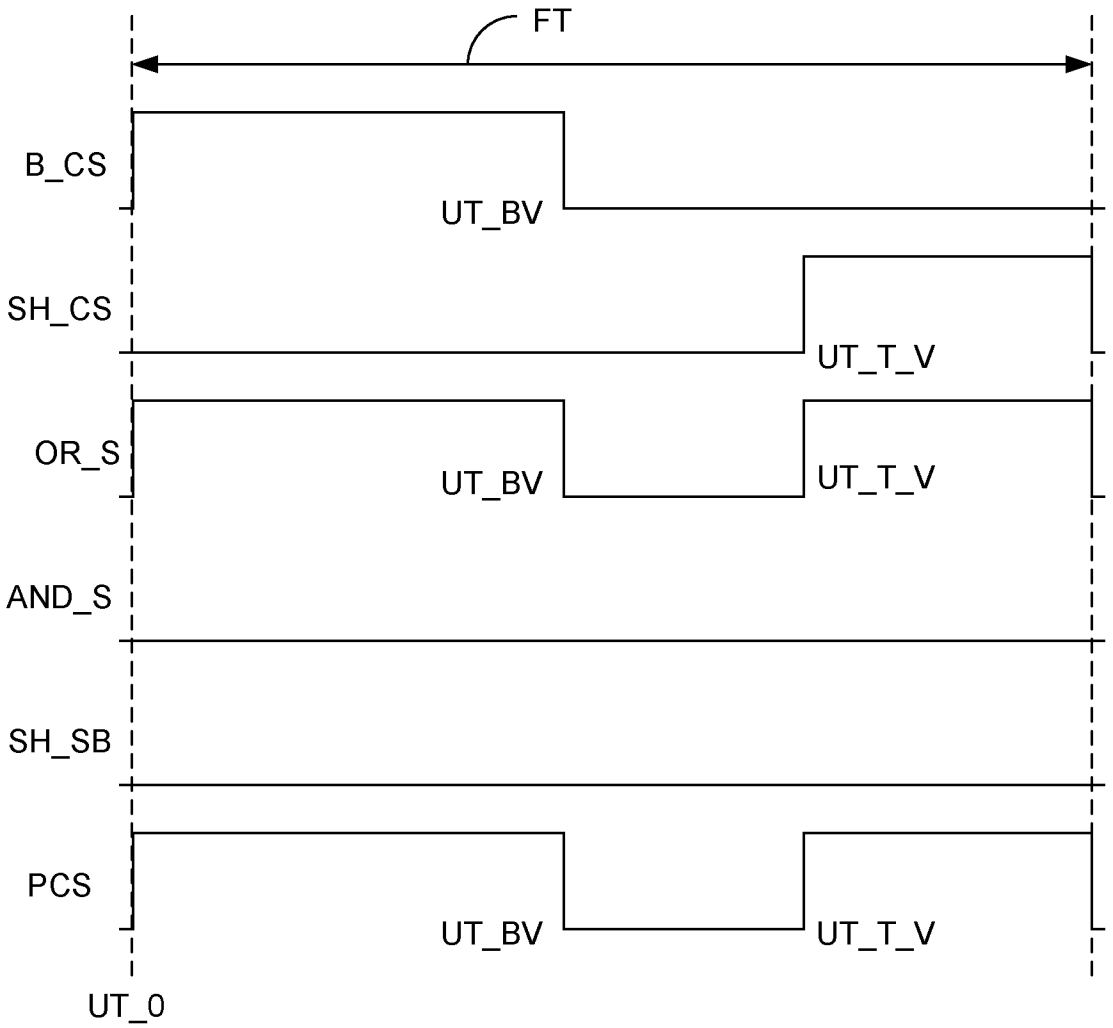
FIGS. 7A-7B shows signals of a novel system to generate pixel control signals in accordance with an embodiment of the present invention.
Figure 7B:
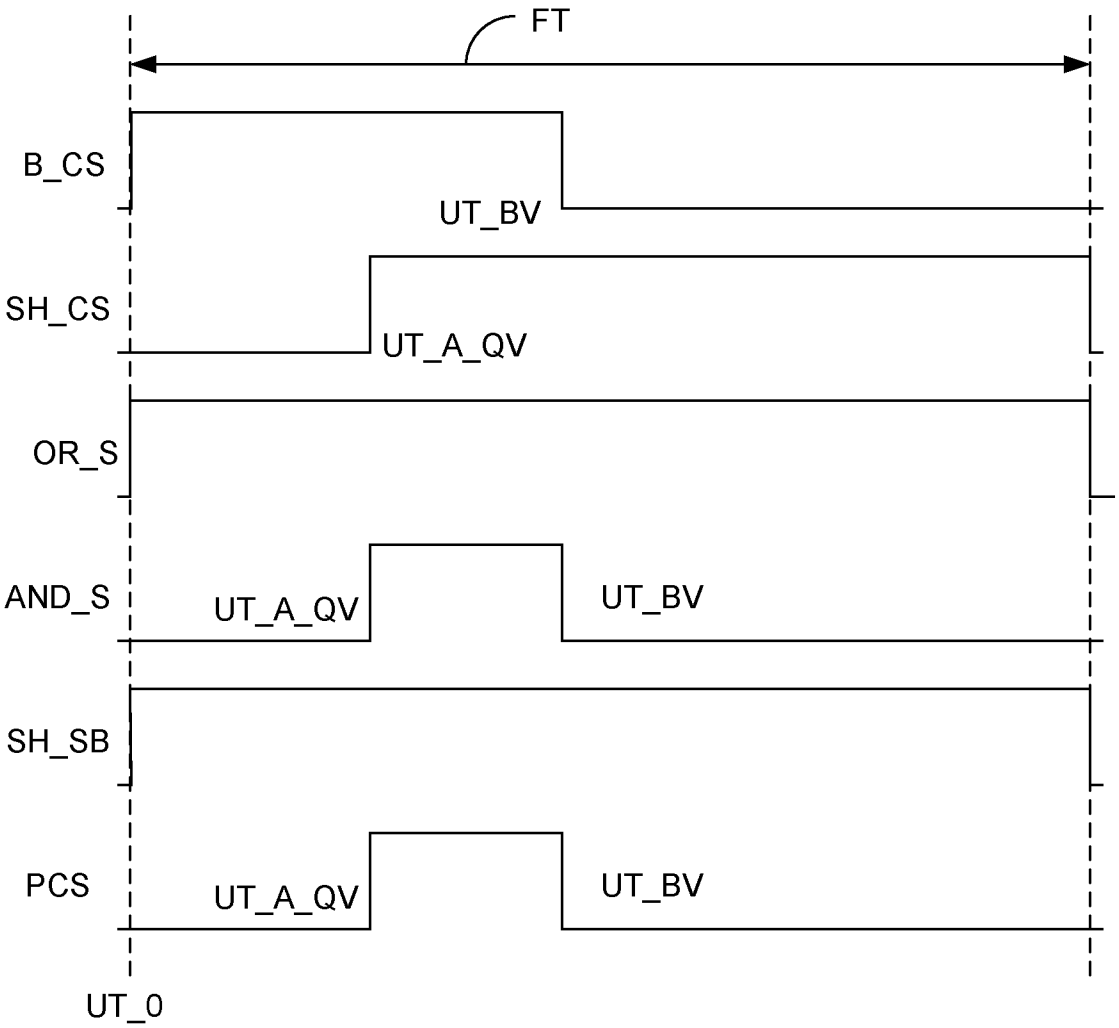

Specifically, FIG. 7A illustrates the signals when quantized value QV of sharpener pixel S_P(X, Y) is positive and FIG. 7B illustrates the signals when quantized value QV of sharpener pixel S_P(X, Y) is negative.

FIG. 6A includes a base image memory cell 610, a sharpener image memory cell 620, and a sharpener sign-bit memory cell 630, an OR gate 640, an AND gate 650, and a multiplexer 660. Base image memory cell 610 outputs a base image control signal B_CS. The pixel processor using the circuit of FIG. 6A controls base image memory cell 610 based on the base value BV in color component of B_C(int(X/2), int(Y/2)). Specifically, if base value BV is greater than 0 then base image control signal B_CS will be at logic high starting at update time U_0 and transition to logic low at update time U_BV during field time period FT. (See FIGS. 7A and 7B) if base value BV is equal to zero then base image control signal B_CS remains at logic low throughout the field time period. Base image control signal B_CS is applied to an input terminal of OR gate 640 and to an input terminal of AND gate 650.

The pixel processor controls sharpener image memory cell 620 based on quantized value QV of sharpener pixel S_P(X, Y) to output a sharpener control signal SH_CS. Specifically, if quantized value QV of sharpener pixel S_P(X, Y) is less than zero, sharpener control signal begins at logic zero and transitions to logic high after the absolute value of quantized value QV update times. In other words, if quantized value QV of sharpener pixel S_P(X, Y) is less than zero then if value A_QV is equal to the absolute value of quantized value QV of sharpener pixel S_P(X, Y), sharpener control signal starts at logic low at update time UT_0, and transitions to logic high at update time UT_A_QV (as shown in FIG. 7B). If quantized value QV of sharpener pixel S_P(X, Y) is greater than zero, sharpener control signal begins at logic zero and transitions to logic high at quantized value QV update times before the end of field time period FT. In other words, if quantized value QV of sharpener pixel S_P(X, Y) is greater than zero then if transition value T_V is equal to the 255 minus quantized value QV of sharpener pixel S_P(X, Y), sharpener control signal starts at logic low at update time UT_0, and transitions to logic high at update time UT_T_V (as shown in FIG. 7A), where transition value T_V is equal to 255 minus quantized value QV of sharpener pixel S_P(X, Y). If quantized value QV of sharpener pixel S_P(X, Y) is equal to zero, sharpener control signal remains at logic low the entire field update period FT. Sharpener control signal SH_CS is applied to an input terminal of OR gate 640 and an input terminal of AND gate 650.

OR gate 640 performs a logic OR function (which is equivalent to a mathematical addition function for pixel control signals) on base image control signal B_CS and sharpener control signal SH_CS and outputs a signal OR_S, which is applied to the logic low (i.e. "0") input terminal of multiplexer 660. Signal OR_S, which is a logic OR signal that combine base image control signal B_CS and sharpener control signal SH_CS, is illustrated in FIGS. 7A and 7B. AND gate 650 performs a logic AND (which is equivalent to a mathematical subtraction function for pixel control signals) function on base image control signal B_CS and sharpener control signal SH_CS and outputs a signal AND_S, which is applied to the logic high (i.e. "1") input terminal of multiplexer 660. Signal AND_S, which is a logic AND signal that combines base image control signal B_CS and sharpener control signal SH_CS, is illustrated in FIGS. 7A and 7B. Sharpener sign-bit memory cell 630 stores the sign bit from sharpener pixel S_P(X, Y). Thus if quantized value QV of sharpener pixel S_P(X, Y) is greater than or equal to zero sharpener sign-bit memory cell 630 stores logic 0 for field time period FT. If quantized value QV of sharpener pixel S_P(X, Y) is less than zero sharpener sign-bit memory cell 630 stores logic 1 for field time period FT. Sharpener sign-bit memory cell outputs a sharpener sign bit signal SH_SB, which is applied to the control terminal of multiplexer 660. Multiplexer 660 outputs signal OR_S as pixel control signal PCS when sharpener sign bit signal SH_SB is at logic low. Multiplexer 660 outputs signal AND_S as pixel control signal PCS when sharpener sign bit signal SH_SB is at logic high. The embodiment of FIG. 6A would function properly whether a zero value of the sharpener were treated as positive or negative number.

Figure 1:
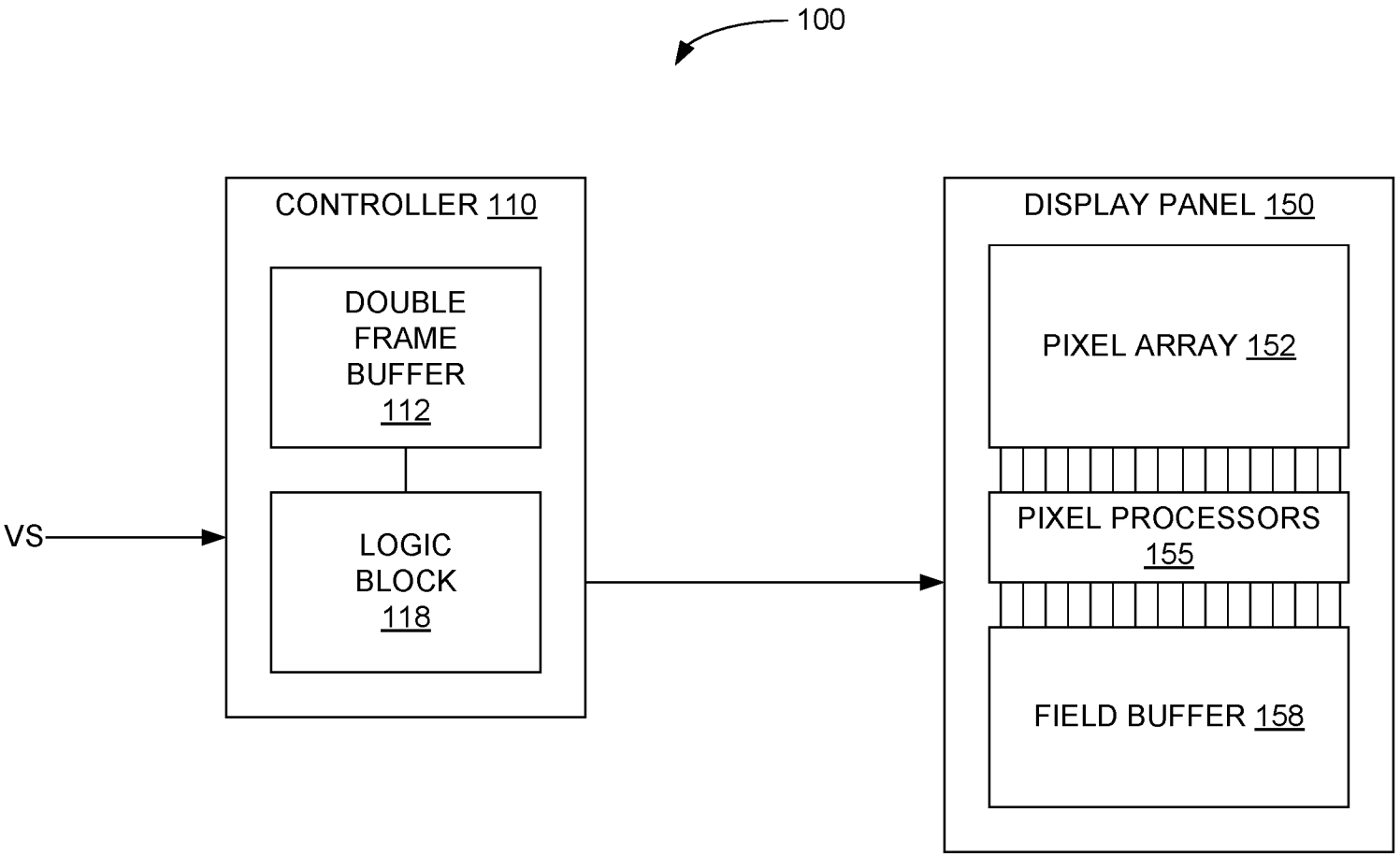
FIG. 1 (Prior Art)
FIG. 1 illustrate a simplified block diagram of a portion of a conventional display.
Figure 2:
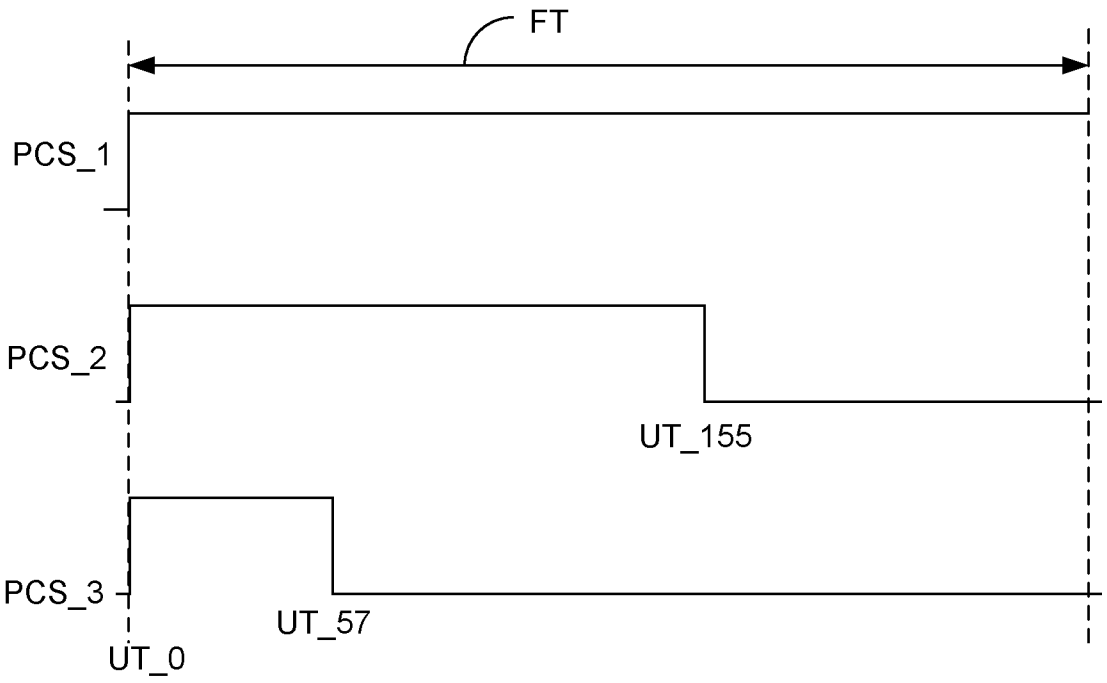
FIG. 2 (Prior Art)
FIG. 2 illustrate pixel control signals.
Figure 3:
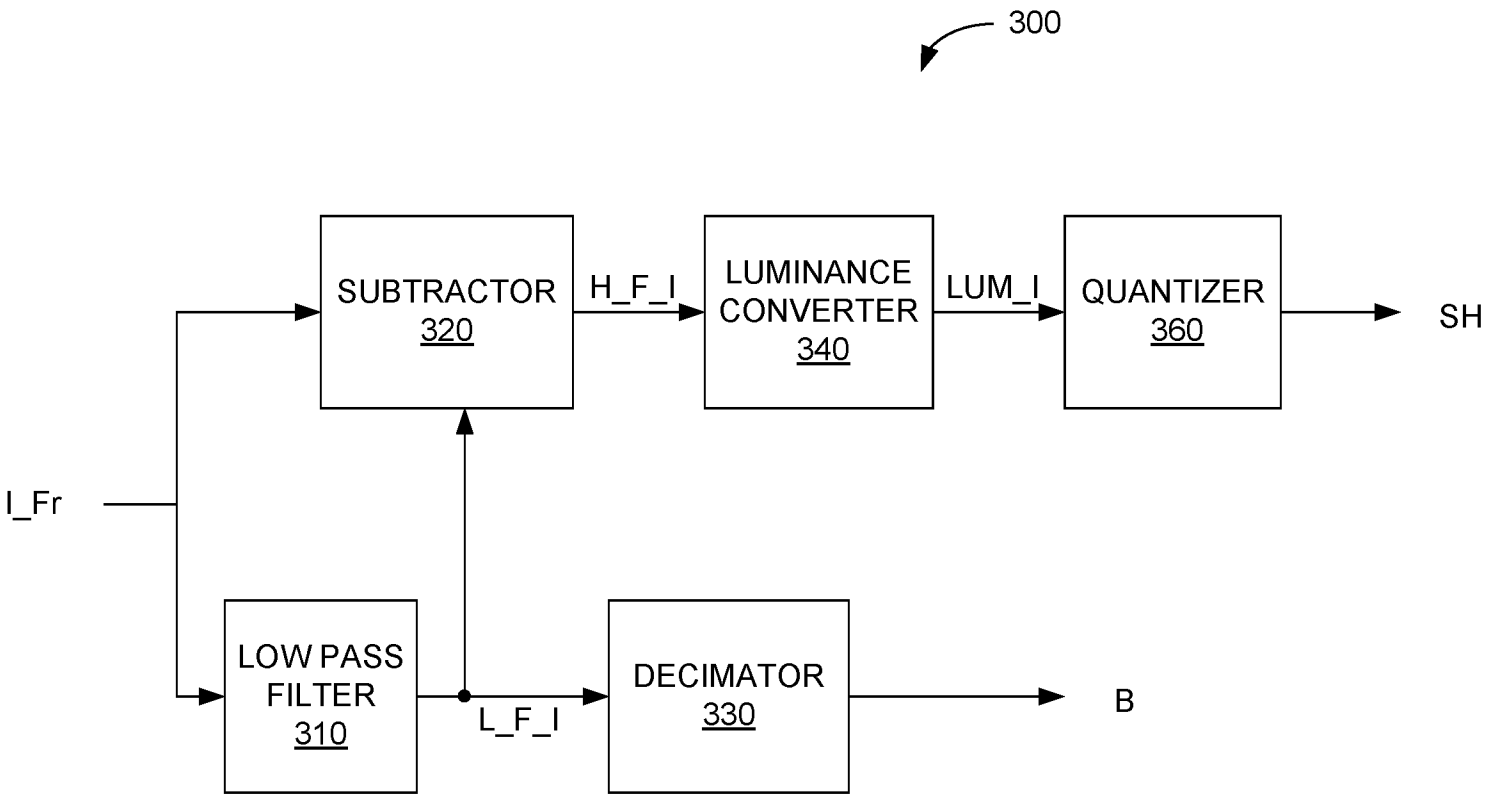
FIG. 3 (Prior Art)
FIG. 3 is diagram of a conventional image compression system.
Figure 4:
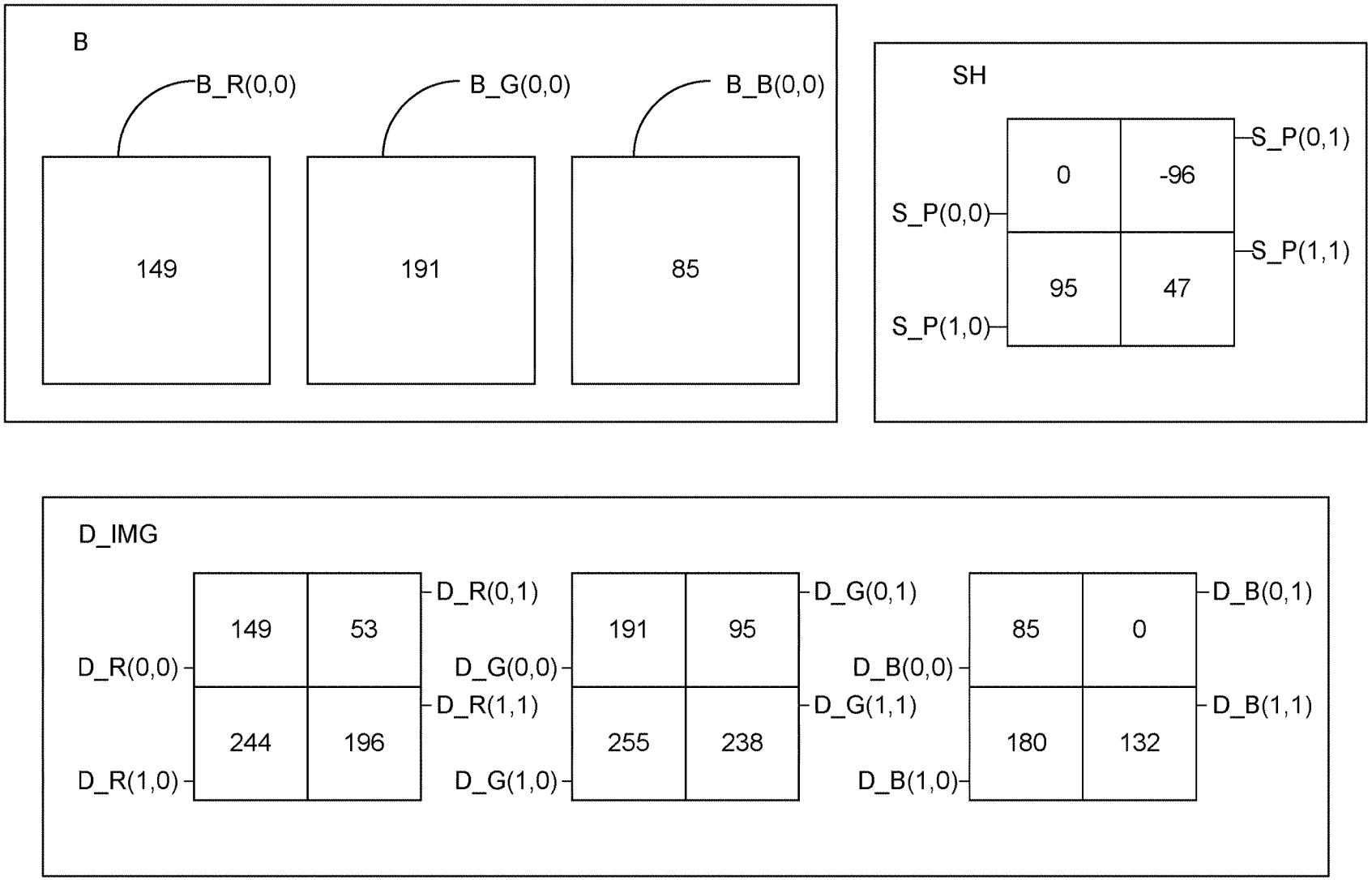
FIG. 4 (Prior Art)
FIG. 4 illustrates portion of images generated using the conventional image compression system.

FIGS. 7A and 7B illustrate the signals for the embodiment of the present invention of FIG. 6A. FIG. 7A shows the signals when quantized value QV of sharpener pixel S_P(X, Y) is greater than or equal to zero; while FIG. 7B shows the signals when quantized value QV of sharpener pixel S_P(X, y) is less than zero. As explained above, base image memory cell 610 outputs base image control signal B_CS which is driven to logic high at update time UT_0 and transitions to logic low at update time UT_BV, where base value BV is the value of color component B_C(int(X/2), int(Y/2)) of pixel B_P(int(X/2), int(Y/2)) of base image B (as explained above). Sharpener image memory cell 620 outputs sharpener control signal SH_CS. For FIG. 7A, quantized value QV of sharpener pixel S_P(X, Y) is positive therefore sharpener control signal SH_CS starts at logic low at update time UT_0, and transitions to logic high at update time UT_T_V, where transition value T_V is equal to 255 minus quantized value QV of sharpener pixel S_P(X, Y). In other words quantized value QV from the end of field time period FT. Signal OR_S is the output of OR gate 640 and is the logic OR of base image control signal B_CS and sharpener control signal SH_CS. Therefore, signal OR_S is at logic high at update time UT_0, transitions to logic low at update time UT_BV and then transitions to logic high at update time UT_T_V. Signal AND_S is the output of AND gate 640 and is the logic AND of base image control signal B_CS and sharpener control signal SH_CS. Therefore, signal AND_S is at logic low for the entirety of field time period FT. Sharpener sign-bit signal SH_SB is the output signal of sharpener sign-bit memory cell 630 and is at logic low for the entirety of field time period FT, because FIG. 7A shows the signals when quantized value QV of sharpener pixel S_P(X, Y) is positive. Multiplexer 660 drives pixel control signal PCS. Because the sharpener sign-bit control signal (which is at logic low for FIG. 7A) is applied to the control terminal of multiplexer 660, multiplexer 660 outputs the signal that is provided to the logic low input terminal of multiplexer 660. Therefore, pixel control signal PCS is a copy of signal OR_S. Consequently pixel control signal PCS is at logic high at update time UT_0, transitions to logic low at update time UT_BV, and transitions to logic high at update time UT_T_V and remains at logic high for the rest of frame update period FT. Thus pixel control signal PCS of FIG. 7A achieves the same results as illustrated in FIGS. 3-5 (in particular see pixel control signals PCS_R(1,0) and PCS_R(1,1) of FIG. 5) by adding the quantized value QV of a sharpener pixel to the color component of a base pixel.

FIG. 7B shows the signals when quantized value QV of sharpener pixel S_P(X, Y) is less than zero. Base image memory cell 610 outputs base image control signal B_CS which is driven to logic high at update time UT_0 and transitions to logic low at update time UT_BV, where base value BV is the value of color component B_C(int(X/2), int(Y/2)) of a pixel B_P(int(X/2), int(Y/2)) of base image B (as explained above). Sharpener image memory cell 620 outputs sharpener control signal SH_CS. For FIG. 7B, quantized value QV of sharpener pixel S_P(X, Y). is negative therefore sharpener control signal SH_CS starts at logic low at update time UT_0, and transitions to logic high at update time UT_A_QV, where transition value A_QV is equal to the absolute value of quantized value QV of sharpener pixel S_P(X, Y). Signal OR_S is the output of OR gate 640 and is the logic OR of base image control signal B_CS and sharpener control signal SH_CS. Therefore, signal OR_S is at logic high for the entirety of field time period FT. Signal AND_S is the output of AND gate 640 and is the logic AND of base image control signal B_CS and sharpener control signal SH_CS. Therefore, signal AND_S is at logic low at update time UT_0, transitions to logic high at update time UT_A_QV and then transitions to logic low at update time UT_BV. Sharpener sign-bit signal SH_SB is the output signal of sharpener sign-bit memory cell 630 and is at logic high for the entirety of field time period FT, because FIG. 7B shows the signals when quantized value QV of sharpener pixel S_P(X, Y) is negative. Multiplexer 660 drives pixel control signal PCS. Because the sharpener sign-bit control signal (which is at logic high for FIG. 7B) is applied to the control terminal of multiplexer 660, multiplexer 660 outputs the signal that is provided to the logic high input terminal of multiplexer 660. Therefore, pixel control signal PCS is a copy of signal AND_S. Consequently pixel control signal PCS logic low at update time UT_0, transitions to logic high at update time UT_A_QV and then transitions to logic low at update time UT_BV and remains at logic low for the rest of frame update period FT. Thus pixel control signal PCS of FIG. 7B achieves the same results as illustrated in FIGS. 3-5 (in particular see pixel control signal PCS_R(0,1) of FIG. 5) by adding quantized value QV (which is negative in FIG. 7B) of a sharpener pixel from the color component of a base pixel.

The purpose of the present invention is to reduce the processing load on the pixel processors to allow for higher resolution and higher frame rates as well as to reduce power consumption. In conventional systems the pixel processors main duty is to update the memory cell that provides the pixel control signal. In conventional systems each pixel has a single memory cell that outputs the pixel control signal. Thus at first glance it would seem the embodiment of the present invention in FIG. 6A should have a greater processing load because it appears that three memory cells are used. However, paradoxically, the three memory cells require less processing than the single memory cell of conventional system. In conventional systems the memory cell may transition at any update time during field time period FT. Thus the pixel processor must determine the status of the memory cell at 256 updates times. For simplicity, assume checking a memory cell at an update time takes one processor meta-action. Then each pixel in the conventional system requires 256 processor meta-actions.

In the embodiment of FIG. 6A, the base image information and the sharpener image information are kept separate. As explained above, a single base pixel is used for four decompressed pixels. Thus, four pixels can share the same base image memory cell. Therefore the 256 meta actions required by the base image memory cell can be shared by four pixels. Accordingly, the processors only need an equivalent of 64 processor meta-actions per pixel for the base image memory cell. The sharpener sign-bit memory cell does not change during field time period FT and thus only requires a single processor meta-action per pixel to set the value at or before update time UT_0. Each pixel does require a distinct sharpener image memory cell, but because quantized value QV of sharpener pixel P(X, Y) can only take on 1 of 16 fixed values, the sharpener image memory cell can only transition at one of 16 fixed update times. Thus, the pixel processor only need to check the sharpener image memory cell at 16 update times during field time period FT. Accordingly, each pixel processor only needs to spend 16 processor meta-actions on sharpener image memory cell. Therefore, the embodiment of the present invention shown in FIG. 6A only requires 81 (64+1+16) processor meta-actions per pixel as compared to 256 for conventional systems. Consequently, systems in accordance with the present invention can handle higher resolutions and frame rates than conventional systems.

Figure 6B:
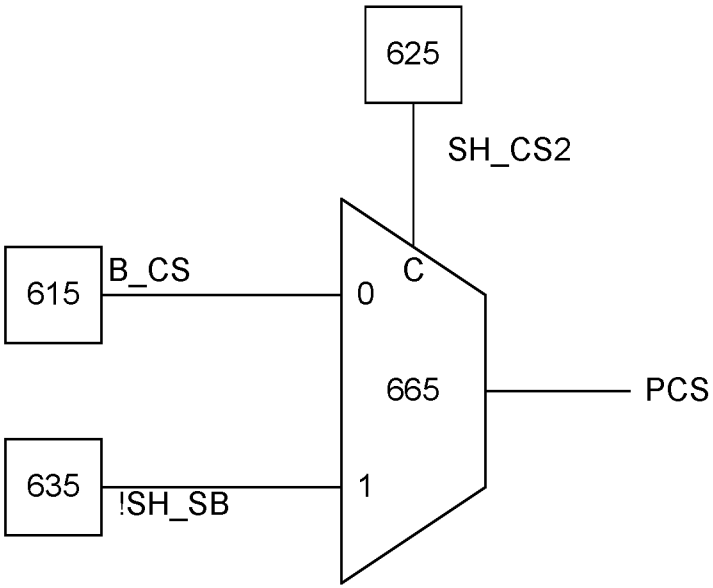
FIG. 6B is a schematic diagram of a novel system to generate pixel control signals in accordance with one embodiment of the present invention.

FIG. 6B shows another embodiment of the present invention that removes the need for the associated comparison logic blocks (i.e. the AND and OR gates). FIG. 6B includes a base image memory cell 615 that generates a base image control signal B_CS, a sharpener image memory cell 625 that generates a sharpener image control signal SH_CS2, an inverted sharpener sign-bit memory cell 635 that generates an inverted sharpener sign bit signal !SH_SB, and a multiplexer 665 that outputs pixel control signal PCS. Base image memory cell 615 is controlled in the same manner as described above with respect to base image memory cell 610 to generate base image control signal. For brevity the description is not repeated. Inverted Sharpener sign-bit memory cell 635 stores the inverted sign bit from sharpener pixel S_P(X, Y). Thus if quantized value QV of sharpener pixel S_P(X, Y) is greater than or equal to zero inverted sharpener sign-bit memory cell 635 stores logic 1 for field time period FT. If quantized value QV of sharpener pixel S_P(X, Y) is less than zero inverted sharpener sign-bit memory cell 635 stores logic 0 for field time period FT. Sharpener sign-bit memory cell outputs an inverted sharpener sign bit signal !SH_SB, which is applied to the logic high input terminal of multiplexer 660.

A slight change is made to the operation of sharpener image memory cell 625 as compared to memory cell 620 of FIG. 6A. The pixel processor controls sharpener image memory cell 625 based on the quantized value QV of sharpener pixel S_P(X, Y) to output a sharpener control signal SH_CS2, which differs slightly from sharpener control signal SH_CS used for the embodiment of FIG. 6A. Specifically, if quantized value QV of sharpener pixel S_P (X, Y) is less than zero, sharpener control signal SH_CS2 begins at logic high and transitions to logic low after the absolute value of quantized value QV update times. In other words, if quantized value QV of sharpener pixel S_P(X, Y) is less than zero then if value A_QV is equal to the absolute value of quantized value QV of sharpener pixel S_P(X, Y), sharpener control signal SH_CS2 starts at logic high at update time UT_0, and transitions to logic low at update time UT_A_QV (as shown in FIG. 7D). If quantized value QV of sharpener pixel S_P(X, Y) is greater than zero, sharpener control signal SH_CS2 begins at logic zero and transitions to logic high at quantized value QV update times before the end of field time period FT. In other words, if quantized value QV of sharpener pixel S_P(X, Y) is greater than zero then if transition value T_V is equal to the 255 minus quantized value QV of sharpener pixel S_P(X, Y), sharpener control signal SH_CS2 starts at logic low at update time UT_0, and transitions to logic high at update time UT_T_V (as shown in FIG. 7C).

In FIG. 6B, base image control signal B_CS is applied to the logic low input terminal of multiplexer 665. Inverted sharpener sign bit signal !SH_SB is applied to the logic high input terminal of multiplexer 665. Sharpener image control signal SH_CS2 is applied to the control terminal of multiplexer 665. Operation of the embodiment of FIG. 6B is explained in more detail with respect to FIGS. 7C and 7D.

Figure 7C:
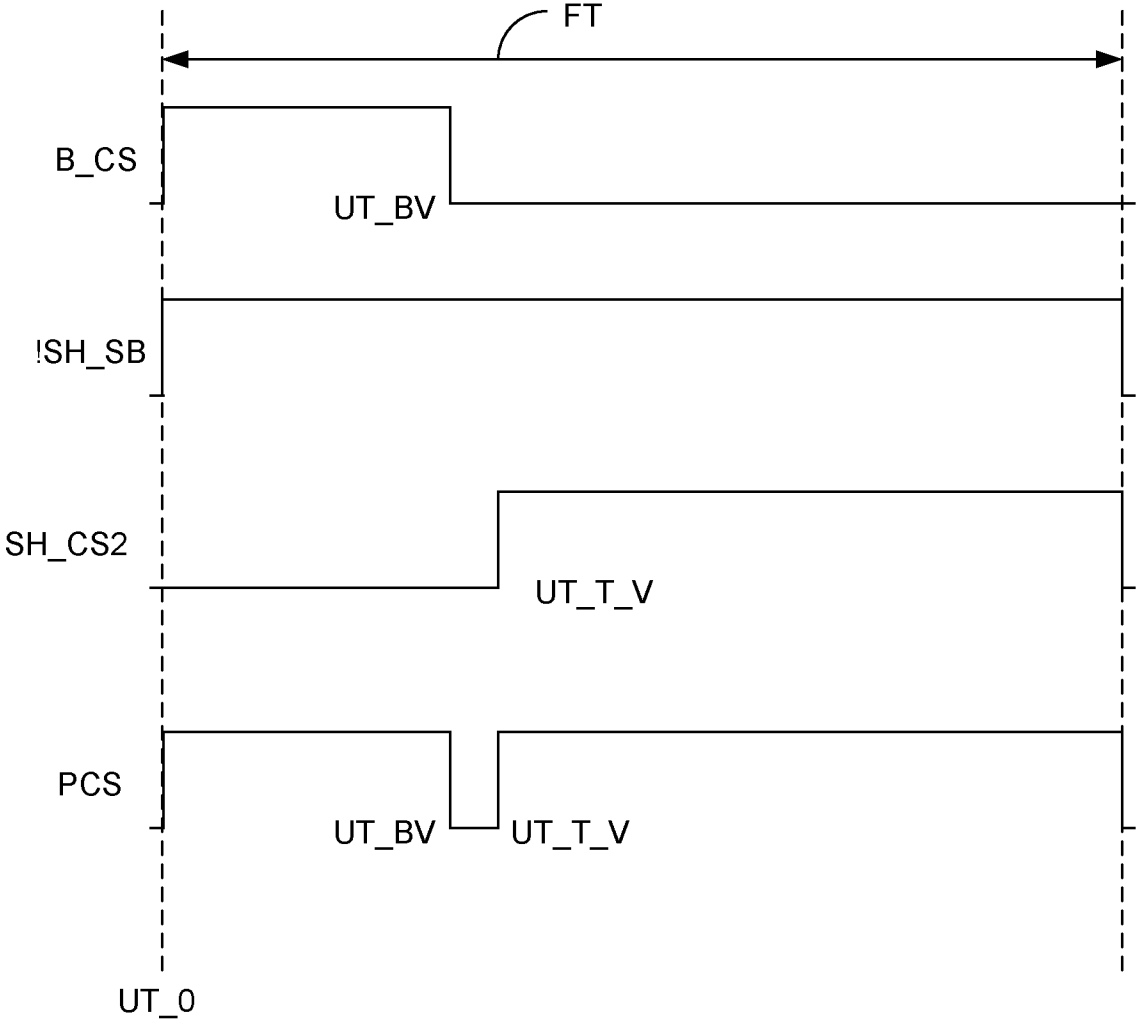
FIGS. 7C-7E shows signals of a novel system to generate pixel control signals in accordance with an embodiment of the present invention.
Figure 7D:
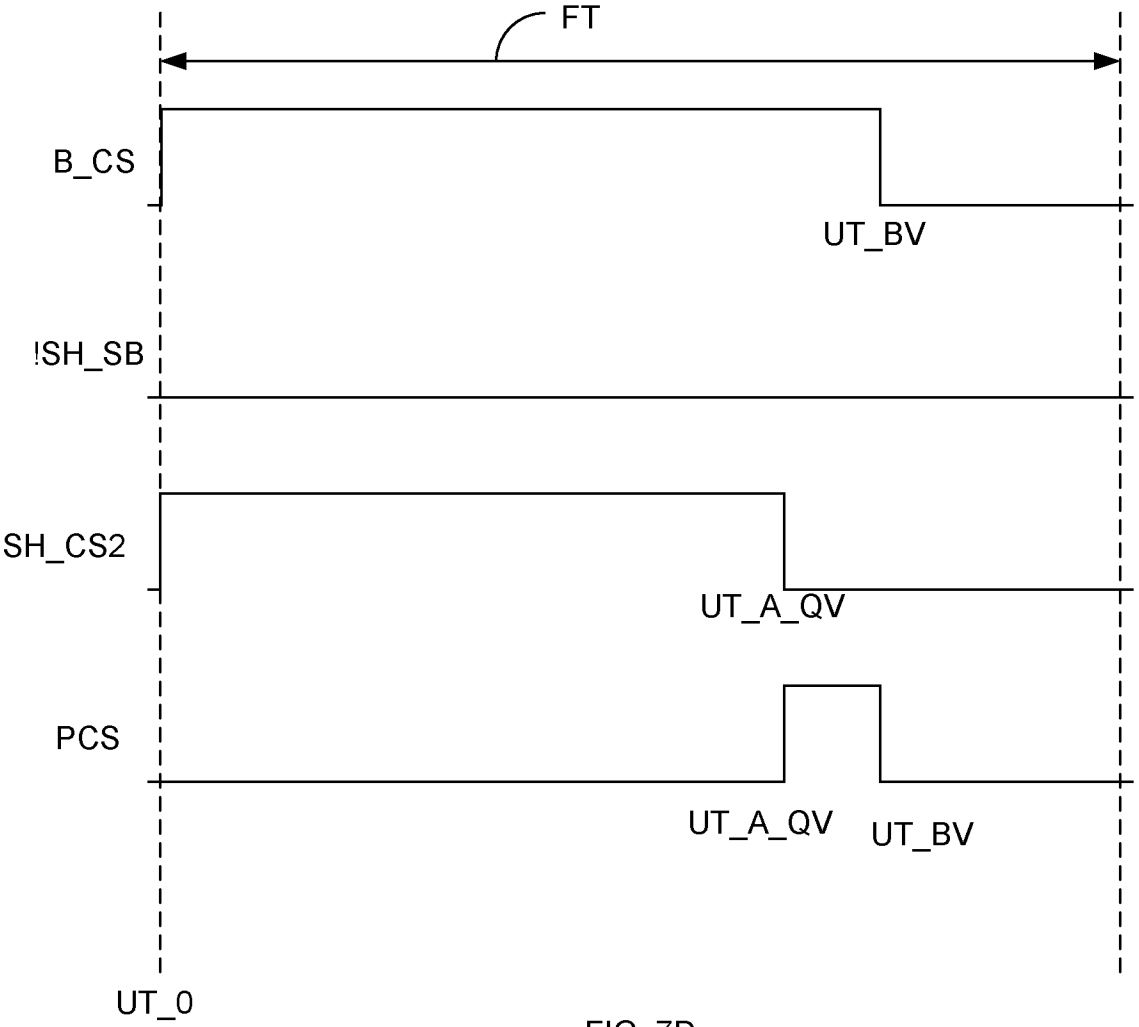
Figure 7E:
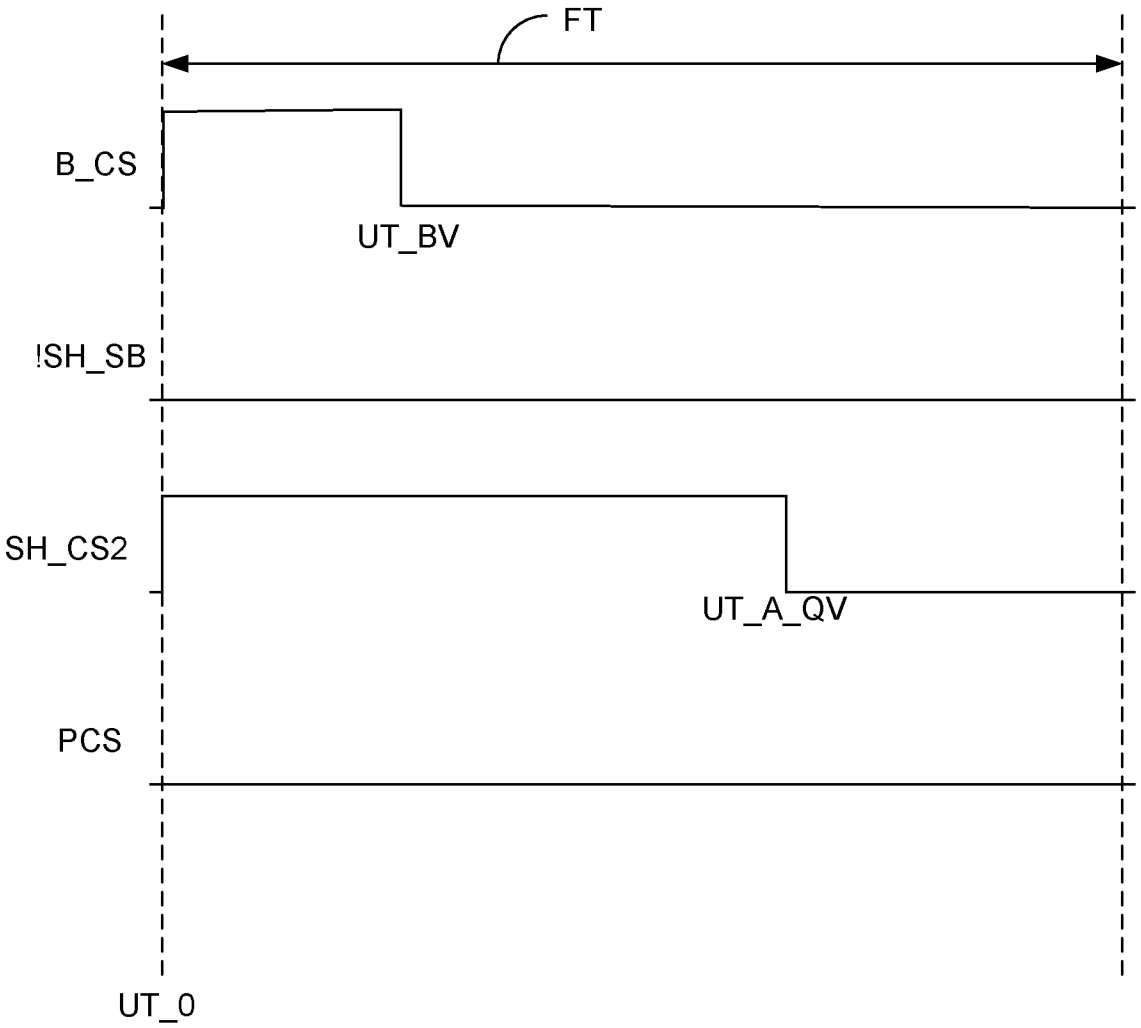

FIGS. 7C and 7E illustrate operation of the embodiment of FIG. 6B. FIG. 7C illustrates the signals when quantized value QV of sharpener pixel S_P(X, Y) is positive. As explained above, base image memory cell 615 outputs base image control signal B_CS which is driven to logic high at update time UT_0 and transitions to logic low at update time UT_BV, where base value BV is the value of color component B_C(int(X/2), int(Y/2)) of a pixel B_P(int(X/2), int(Y/2)) of base image B (as explained above). Inverted sharpener sign bit memory cell 635 stores the inverted sign bit of quantized value QV of pixel S_P(X, Y). In FIG. 7C, quantized value QV of sharpener pixel S_P(X, Y) is positive. Therefore the sign bit of quantized value is zero and the inverted sign bit is one. Accordingly, inverted sharpener sigh bit signal !SH_SB is at logic high during frame update period FT. Sharpener image memory cell 625 outputs sharpener control signal SH_CS2. For FIG. 7C, quantized value QV of sharpener pixel S_P(X, Y) is positive; therefore, sharpener control signal SH_CS2 starts at logic low at update time UT_0, and transitions to logic high at update time UT_T_V, where transition value T_V is equal to 255 minus quantized value QV of sharpener pixel S_P(X, Y). Sharpener image control signal SH_CS2 controls Multiplexer 665, which drives pixel control signal PCS. When sharpener image control signal SH_CS2 is at logic low, multiplexer outputs a copy of base image control signal B_CS as pixel control signal PCS. However, when sharpener image control signal SH_CS2 is at logic high, multiplexer 665 outputs a copy of inverted sharpener sign bit signal !SH_SB as pixel control signal PCS. Consequently pixel control signal PCS is at logic high at update time UT_0, transitions to logic low at update time UT_BV, and transitions to logic high at update time UT_T_V and remains at logic high for the rest of frame update period FT. Thus pixel control signal PCS of FIG. 7C achieves the same results as illustrated in FIGS. 3-5 (in particular see pixel control signals PCS_R(1,0) and PCS_R(1,1) of FIG. 5) by adding the quantized value QV of a sharpener pixel to the color component of a base pixel.

FIG. 7D illustrates the signals when quantized value QV of sharpener pixel S_P(X, Y) is negative. As explained above, base image memory cell 615 outputs base image control signal B_CS which is driven to logic high at update time UT_0 and transitions to logic low at update time UT_BV, where base value BV is the value of color component B_C(int(X/2), int(Y/2)) of a pixel B_P(int(X/2), int(Y/2)) of base image B (as explained above). Sharpener image memory cell 625 outputs sharpener control signal SH_CS2. For FIG. 7D, quantized value QV of sharpener pixel S_P(X, Y) is negative therefore sharpener control signal SH_CS2 starts at logic high at update time UT_0, and transitions to logic low at update time UT_A_QV, where transition value A_QV is equal to the absolute value of quantized value QV of sharpener pixel S_P(X, Y). In FIG. 7D, quantized value QV of sharpener pixel S_P(X, Y) is negative. Therefore the sign bit of quantized value is one and the inverted sign bit is zero. Accordingly, inverted sharpener sign bit signal !SH_SB is at logic low during frame update period FT. Sharpener image control signal SH_CS2 controls Multiplexer 665, which drives pixel control signal PCS. When sharpener image control signal SH_CS2 is at logic low, multiplexer outputs a copy of base image control signal B_CS as pixel control signal PCS. However, when sharpener image control signal SH_CS2 is at logic high, multiplexer 665 outputs a copy of inverted sharpener sign bit signal !SH_SB as pixel control signal PCS. Consequently pixel control signal PCS is at logic low at update time UT_0, transitions to logic high at update time UT_A_QV, and transitions to logic low at update time UT_BV and remains at logic low for the rest of frame update period FT. Thus pixel control signal PCS of FIG. 7D achieves the same results as illustrated in FIGS. 3-5 (in particular see pixel control signal PCS_R(0,1) of FIG. 5) by adding the quantized value QV (which is negative in FIG. 7D) of a sharpener pixel to the color component of a base pixel.

FIG. 7E again illustrates the signals when quantized value QV of sharpener pixel S_P(X, Y) is negative. However, in FIG. 7E the magnitude of the quantized value QV of sharpener pixel S_P(X, y) is greater than the magnitude base value BV. The embodiment of FIG. Just as in FIG. 7D, image control signal B_CS which is driven to logic high at update time UT_0 and transitions to logic low at update time UT_BV; sharpener control signal SH_CS2 starts at logic high at update time UT_0 and transitions to logic low at update time UT_A_QV; and inverted sharpener sign bit signal !SH_SB is at logic low during frame update period FT. However, in FIG. 7E update time UT_A_QV occurs after update time UT_BV because the magnitude of the quantized value QV of sharpener pixel S_P(X, y) is greater than the magnitude base value BV accordingly the pixel control signal should be at logic low for the duration frame update period FT. Sharpener image control signal SH_CS2 controls Multiplexer 665, which drives pixel control signal PCS. When sharpener image control signal SH_CS2 is at logic low, multiplexer outputs a copy of base image control signal B_CS as pixel control signal PCS. However, when sharpener image control signal SH_CS2 is at logic high, multiplexer 665 outputs a copy of inverted sharpener sign bit signal !SH_SB as pixel control signal PCS. Consequently pixel control signal PCS is at logic low at update time UT_0 and remains at logic low for the rest of frame update period FT. Thus pixel control signal PCS of FIG. 7E achieves the same results as illustrated in FIGS. 3-5 (in particular see blue component D_B(0, 1) in FIG. 4) by adding the quantized value QV (which is negative in FIG. 7E) of a sharpener pixel to the color component of a base pixel.

Figure 8:
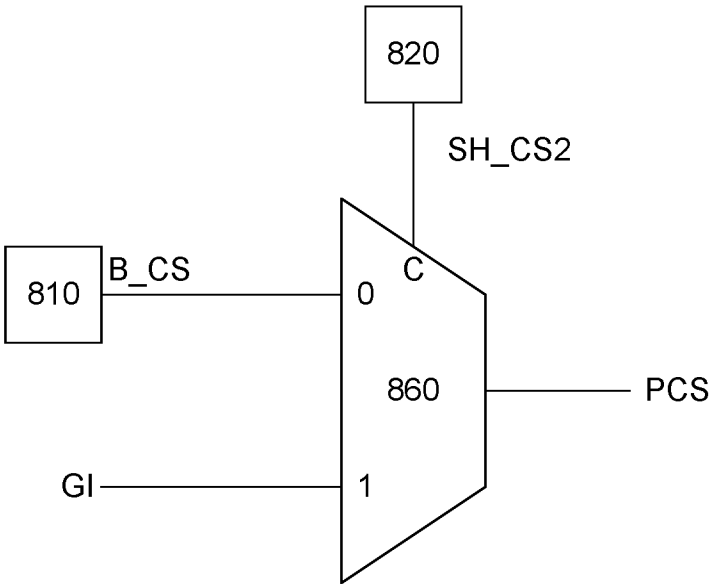
FIG. 8 is a schematic diagram of a novel system to generate pixel control signals in accordance with one embodiment of the present invention.

FIG. 8 shows another embodiment of the present invention that removes the inverted sharpener sign-bit memory cell of FIG. 6B. While removing the inverted sharpener sign-bit memory cell only saves 1 processor meta-action per field time period FT, removing the memory cell allows for more densely packed display pixels. FIG. 8 includes a base image memory cell 810 that generates a base image control signal B_CS, a sharpener image memory cell 820 that generates a sharpener image control signal SH_CS2, and a multiplexer 860 that outputs pixel control signal PCS. Base image memory cell 810 is controlled in the same manner as described above with respect to base image memory cell 610 and 615 to generate base image control signal. For brevity the description is not repeated. Similarly, sharpener image memory cell 820 is controlled in the same manner as described above with respect to sharpener image memory cell 625 to generate sharpener image control signal SH_CS2.

In FIG. 8, base image control signal B_CS is applied to the logic low input terminal of multiplexer 860. A global input signal GI is applied to the logic high input terminal of multiplexer 860. Sharpener image control signal SH_CS2 is applied to the control terminal of multiplexer 860. Because subtraction of quantized value QV of sharpener pixel P(X, Y) would occur at the beginning the field time period while addition of quantized value of quantized value QV of sharpener pixel P(X, Y) occurs at the end of field time period FT, global input signal GI begins at logic low at update time UT_0 and transitions to logic high at some point called the global transition time GT at update time UT_GT, and global input signal GI remains at logic high for the rest of field update period FT. In most embodiments of the present invention global transition time GT is set at 128, i.e. the middle of the frame update period. However some embodiments of the present invention will use a different fixed global transition time, while other embodiments of the present invention may have a dynamic global transition time that may vary from field to field or even between rows, columns, or other groupings of the same field. Operation of the embodiment of FIG. 8 is explained in more detail with respect to FIGS. 9A and 9B.

Figure 9A:
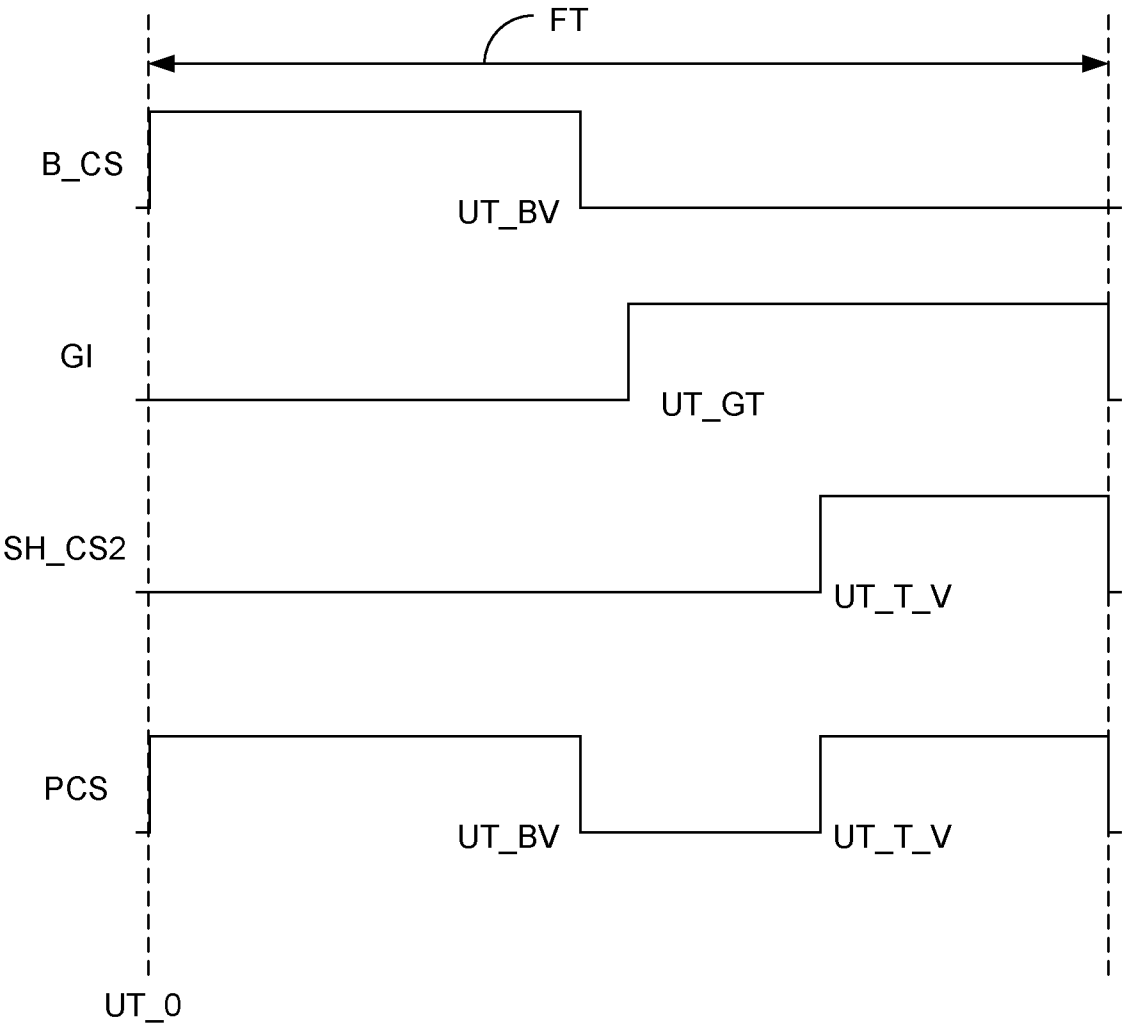
FIGS. 9A-9B shows signals of a novel system to generate pixel control signals in accordance with an embodiment of the present invention.
Figure 9B:
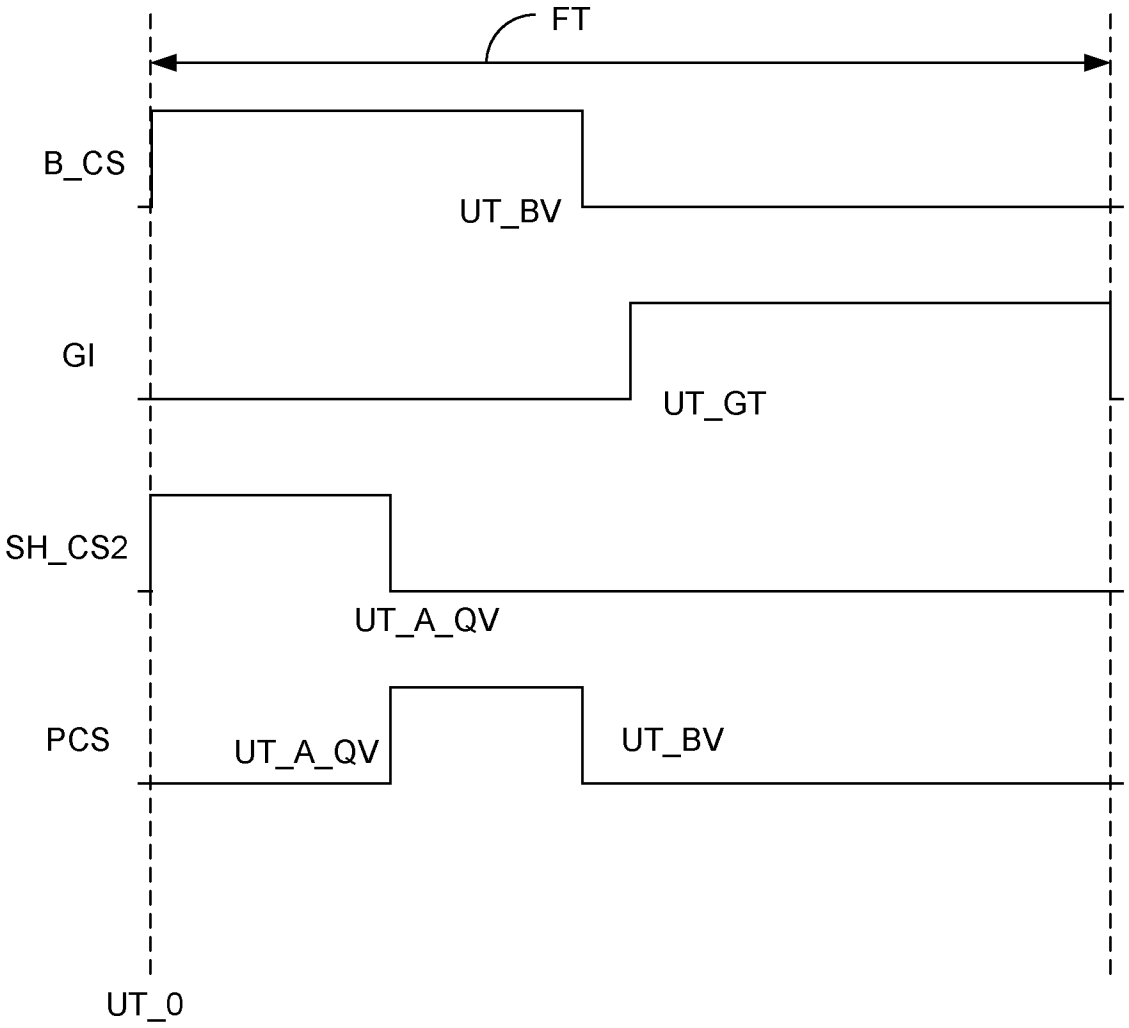

FIGS. 9A and 9B illustrate operation of the embodiment of FIG. 8. FIG. 9A illustrates the signals when quantized value QV of sharpener pixel S_P(X, Y) is positive. As explained above, base image memory cell 810 outputs base image control signal B_CS which is driven to logic high at update time UT_0 and transitions to logic low at update time UT_BV, where base value BV is the value of color component B_C(int(X/2), int(Y/2)) of a pixel B_P(int(X/2), int(Y/2)) of base image B (as explained above). Global input signal GI is at logic low at update tome UT_0 and transitions to logic high at update time UT_GT, where GT is the global transition time. Sharpener image memory cell 820 outputs sharpener control signal SH_CS2. For FIG. 9A, quantized value QV of sharpener pixel S_P(X, Y) is positive; therefore, sharpener control signal SH_CS2 starts at logic low at update time UT_0, and transitions to logic high at update time UT_T_V, where transition value T_V is equal to 255 minus quantized value QV of sharpener pixel S_P(X, Y). Sharpener image control signal SH_CS2 controls Multiplexer 860, which drives pixel control signal PCS. When sharpener image control signal SH_CS2 is at logic low, multiplexer outputs a copy of base image control signal B_CS as pixel control signal PCS. However, when sharpener image control signal SH_CS2 is at logic high, multiplexer 860 outputs a copy of global input signal GI as pixel control signal PCS. Consequently pixel control signal PCS is at logic high at update time UT_0, transitions to logic low at update time UT_BV, and transitions to logic high at update time UT_T_V and remains at logic high for the rest of frame update period FT. Thus pixel control signal PCS of FIG. 9A achieves the same results as illustrated in FIGS. 3-5 (in particular see pixel control signals PCS_R(1,0) and PCS_R(1,1) of FIG. 5) by adding the quantized value QV of a sharpener pixel to the color component of a base pixel.

FIG. 9B illustrates the signals when quantized value QV of sharpener pixel S_P(X, Y) is negative. As explained above, base image memory cell 810 outputs base image control signal B_CS which is driven to logic high at update time UT_0 and transitions to logic low at update time UT_BV, where base value BV is the value of color component B_C(int(X/2), int(Y/2)) of a pixel B_P(int(X/2), int(Y/2)) of base image B (as explained above). Global input signal GI is at logic low at update time UT_0 and transitions to logic high at update time UT_GT, where GT is the global transition time. Sharpener image memory cell 820 outputs sharpener control signal SH_CS2. For FIG. 9B, quantized value QV of sharpener pixel S_P(X, Y) is negative therefore sharpener control signal SH_CS2 starts at logic high at update time UT_0, and transitions to logic low at update time UT_A_QV, where transition value A_QV is equal to the absolute value of quantized value QV of sharpener pixel S_P(X, Y). Sharpener image control signal SH_CS2 controls Multiplexer 860, which drives pixel control signal PCS. When sharpener image control signal SH_CS2 is at logic low, multiplexer outputs a copy of base image control signal B_CS as pixel control signal PCS. However, when sharpener image control signal SH_CS2 is at logic high, multiplexer 860 outputs a copy of global input signal GI as pixel control signal PCS. Consequently pixel control signal PCS is at logic low at update time UT_0, transitions to logic high at update time UT_A_QV, and transitions to logic low at update time UT_BV and remains at logic low for the rest of frame update period FT. Thus pixel control signal PCS of FIG. 9B achieves the same results as illustrated in FIGS. 3-5 (in particular see pixel control signal PCS_R(0,1) of FIG. 5) by adding the quantized value QV (which is negative in FIG. 9*b*) of a sharpener pixel to the color component of a base pixel.

Although not shown in FIGS. 9A and 9B, there are limitations to the embodiment of FIG. 8. In particular for the embodiment of FIG. 8, addition is limited by the number of update times remaining after update time UT_GT, i.e. the number of update times that global input GI is at logic high. For example if in FIG. 9A, update time UT_GT, where global input signal GI transitions to logic high occurs after update time UT_T_V, where sharpener control signal SH_CS2 transitions to logic high, pixel control signal PCS would not transition again to logic high until update time UT_GT, which would result in the decompressed pixel being dimmer than desired.

Furthermore, subtraction is limited by the number of update times before update time UT_GT, i.e. the number of update times global input signal GI is at logic low. For example if in FIG. 9B, update time UT_GT, where global input signal GI transitions to logic high occurs before update time UT_T_V, where sharpener control signal SH_CS2 transitions to logic high, pixel control signal PCS would transition to logic high at update time UT_GT, which would result in the decompressed pixel being brighter than desired. Thus the image quality of the decompressed image will be reduced for pixels in which the magnitude quantized values QV of sharpener pixel S_P(X, Y) is high relative to global transition time GT. However as explained above, in general larger quantization errors are acceptable for larger changes in high frequency luma components because those errors are less detectable in the edges or textures of the input image.

Some embodiments of the present invention improve the results of the embodiment of FIG. 8 by selecting a range of sharpener values that are inside the known range of the correction capability provided by global input signal GI. For example in one embodiment of the present invention, the maximum positive sharpener value is less than or equal to the number of update times that the global input is at logic high (i.e. 256 minus UT_GT). The maximum magnitude of the negative sharpener value is less than or equal to the number of update times that global input signal GI is at logic low (i.e. UT_GT). Other embodiments of the present invention expand upon the embodiment of FIG. 8 by dividing the display into a set of regions. Each region uses a region input signal instead of using a global input signal for the entire display.

Figure 10:
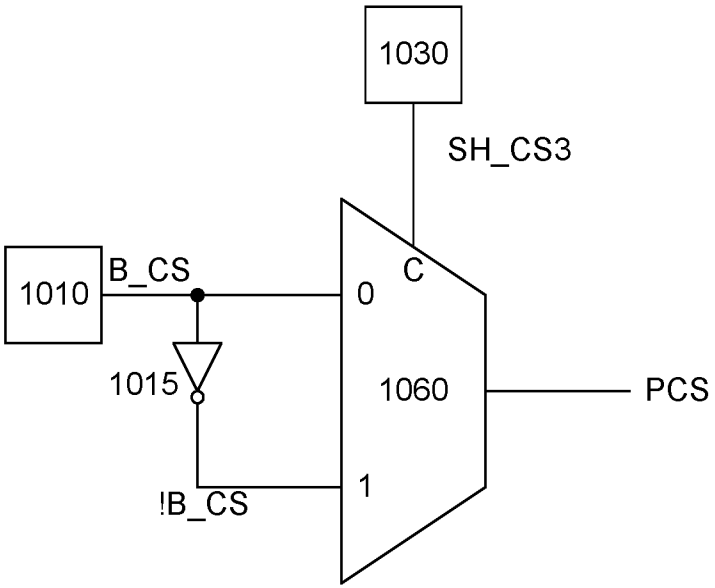
FIG. 10 is a schematic diagram of a novel system to generate pixel control signals in accordance with one embodiment of the present invention.

However, FIG. 10 shows an embodiment of the present invention that addresses the range limitation issues of the embodiment of FIG. 8. FIG. 10 includes a base image memory cell 1010 that generates a base image control signal B_CS, a sharpener image memory cell 1030 that generates a sharpener image control signal SH_CS3, and a multiplexer 1060 that outputs pixel control signal PCS. Base image memory cell 1010 is controlled in the same manner as described above with respect to base image memory cell 610 to generate base image control signal B_CS. For brevity the description is not repeated. Base image control signal B_CS is applied to an input terminal of inverter 1015 which outputs an inverted base image control signal !B_CS. Sharpener image memory cell 1030 is controlled in a similar manner as described above with respect to sharpener image memory cell 625 to generate sharpener image control signal SH_CS3. However, sharpener image control signal SH_CS3 is configured to transition at an update time that is reasonable with respect to base value BV and inverted base image control signal !B_CS. Specifically, the combination of base value BV with quantized value QV of the sharpener pixel should be in the range of 0 to 255+/− an acceptable variance. Some embodiments of the present invention, selects quantized value QV at the time of generating the sharpener value such that the quantized value QV of the sharpener is limited to an addition value that is approximately less than or equal to 255—base value BV and a subtraction value that is approximately less than or equal to base value BV. In other embodiments, the generation of sharpener control signal SH_CS3 is tested against the sharpener and base value to determine the correct transition time. Additional sharpener compare times can be generated against the sharpener quantized values and base values to further improve image performance. In FIG. 10, base image control signal B_CS is applied to the logic low input terminal of multiplexer 1060. Instead of using global input signal GI, inverted base image control signal !B_CS from the output terminal of inverter 1015 is applied to the logic high input terminal of multiplexer 1060. In some embodiments of the present invention base image memory cell 1010 can output inverted base image control signal !B_S directly and inverter 1015 is not used. Multiplexer 1060 outputs pixel control signal PCS. Operation of the embodiment of FIG. 10 is explained in more detail with respect to FIGS. 11A and 11B.

Figure 11A:
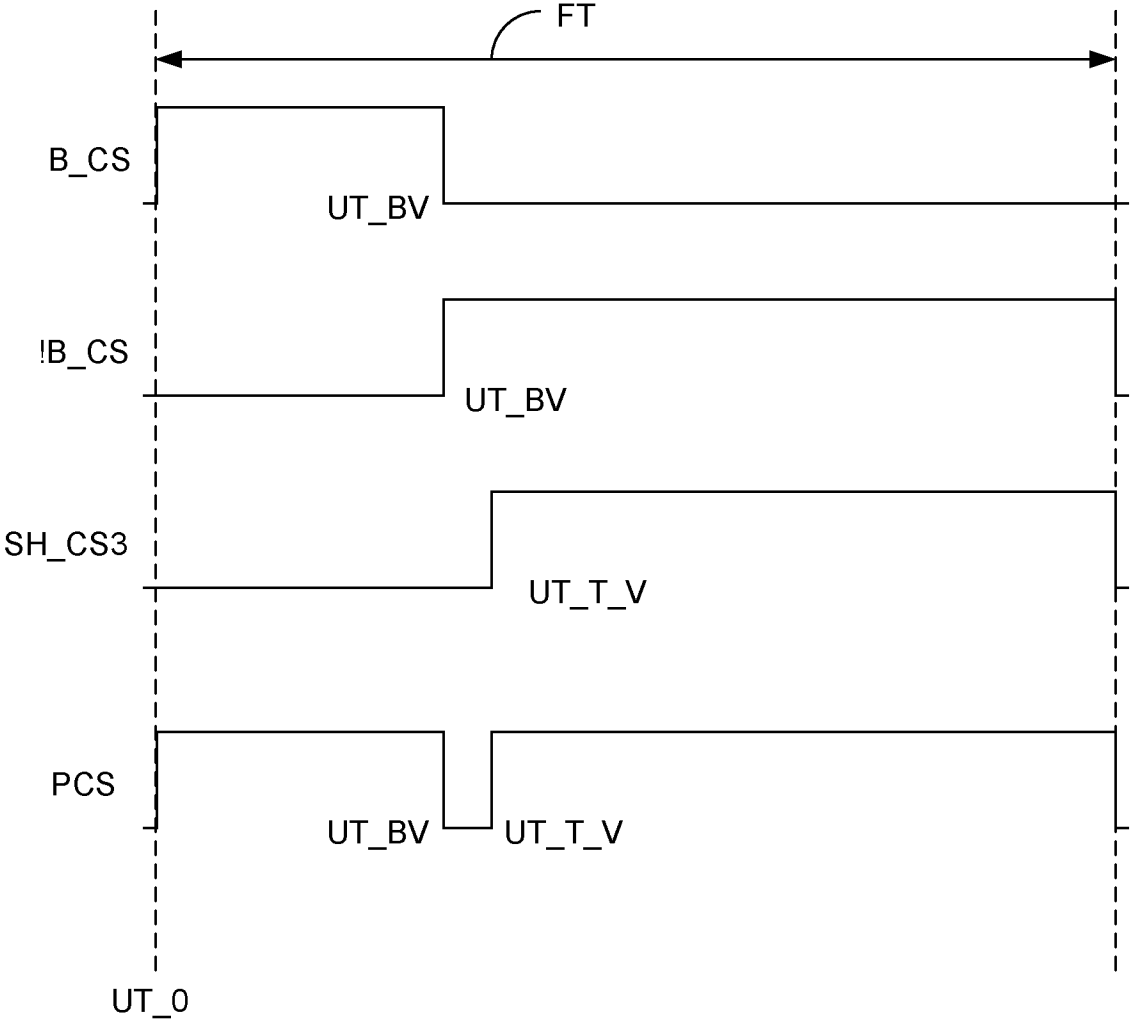
FIGS. 11A-11B shows signals of a novel system to generate pixel control signals in accordance with an embodiment of the present invention.
Figure 11B:
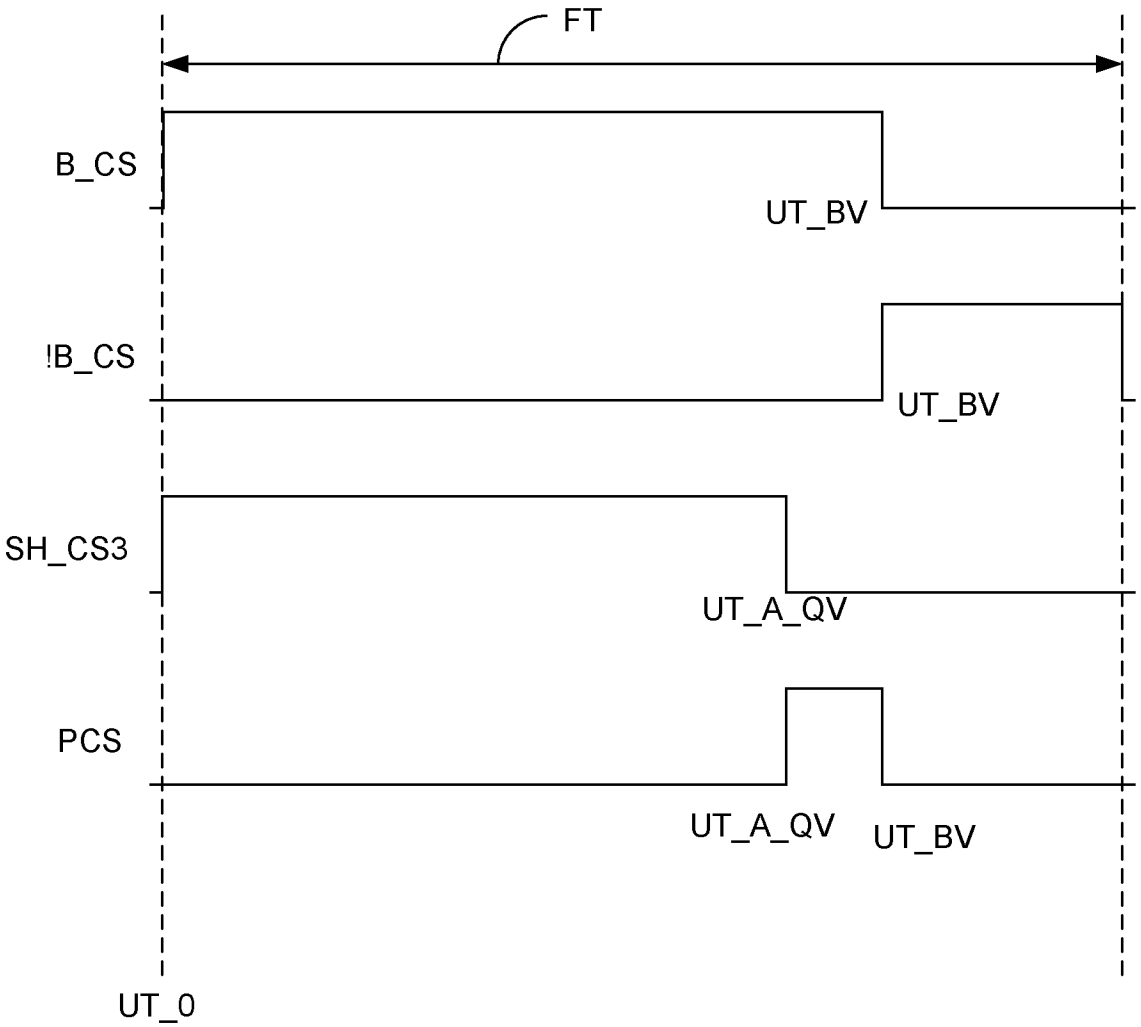

FIGS. 11A and 11B illustrate operation of the embodiment of FIG. 10. FIG. 11A illustrates the signals when quantized value QV of sharpener pixel S_P(X, Y) is positive. As explained above, base image memory cell 1010 outputs base image control signal B_CS which is driven to logic high at update time UT_0 and transitions to logic low at update time UT_BV, where base value BV is the value of color component B_C(int(X/2), int(Y/2)) of a pixel B_P(int(X/2), int(Y/2)) of base image B (as explained above). Inverted base image control signal !B_CS is at logic low at update time UT_0 and transitions to logic high at update time UT_BV. Sharpener image memory cell 1030 outputs sharpener control signal SH_CS3. For FIG. 11A, quantized value QV of sharpener pixel S_P(X, Y) is positive therefore sharpener control signal SH_CS3 starts at logic low at update time UT_0, and transitions to logic high at update time UT_T_V, where transition value T_V is equal to 255 minus quantized value QV of sharpener pixel S_P(X, Y). In FIG. 11A, update time UT_T_V is earlier than in FIG. 9A to better illustrate the advantage of the embodiment of FIG. 10 over the embodiment of FIG. 8 similarly, update time UT_BV is also earlier (indicating a larger magnitude of quantized value QV addition capability for smaller values of base value BV). Sharpener image control signal SH_CS3 controls Multiplexer 1060, which drives pixel control signal PCS. When sharpener image control signal SH_CS3 is at logic low, multiplexer 1060 outputs a copy of base image control signal B_CS as pixel control signal PCS. However, when sharpener image control signal SH_CS3 is at logic high, multiplexer 1060 outputs a copy of inverted base image control signal !B_CS as pixel control signal PCS. Consequently pixel control signal PCS is at logic high at update time UT_0, transitions to logic low at update time UT_BV, and transitions to logic high at update time UT_T_V and remains at logic high for the rest of frame update period FT. Thus pixel control signal PCS of FIG. 11A achieves the same results as illustrated in FIGS. 3-5 (in particular see pixel control signals PCS_R(1,0) and PCS_R(1,1) of FIG. 5) by adding the quantized value QV of a sharpener pixel to the color component of a base pixel. If global input signal GI as shown in FIGS. 9A and 9B had been used in place of inverted base image signal !B_CS the resulting pixel control signal PCS would be at logic high at update time UT_0, transitions to logic low at update time UT_BV, and transitions to logic high at update time UT_GT and remains at logic high for the rest of frame update period FT, which would have more time at logic low than desired because update time UT_GT would be later than update time UT_BV.

FIG. 11B illustrates the signals when quantized value QV of sharpener pixel S_P(X, Y) is negative. As explained above, base image memory cell 1010 outputs base image control signal B_CS which is driven to logic high at update time UT_0 and transitions to logic low at update time UT_BV, where base value BV is the value of color component B_C(int(X/2), int(Y/2)) of a pixel B_P(int(X/2), int(Y/2)) of base image B (as explained above). Inverted base image control signal !B_CS is at logic low at update time UT_0 and transitions to logic high at update time UT_BV. Sharpener image memory cell 1030 outputs sharpener control signal SH_CS3. For FIG. 11B, quantized value QV of sharpener pixel S_P(X, Y) is negative therefore sharpener control signal SH_CS3 starts at logic high at update time UT_0, and transitions to logic low at update time UT_A_QV, where transition value A_QV is equal to the absolute value of quantized value QV of sharpener pixel S_P(X, Y). In FIG. 11B, update time UT_A_QV is later than in FIG. 9B to better illustrate the advantage of the embodiment of FIG. 10 over the embodiment of FIG. 8 similarly, update time UT_BV is also later (indicating a larger magnitude of quantized value QV subtraction capability for larger values of base value BV). Sharpener image control signal SH_CS3 controls Multiplexer 1060, which drives pixel control signal PCS. When sharpener image control signal SH_CS3 is at logic low, multiplexer outputs a copy of base image control signal B_CS as pixel control signal PCS. However, when sharpener image control signal SH_CS3 is at logic high, multiplexer 1060 outputs a copy of inverted base image control signal !B_CS as pixel control signal PCS. Consequently, pixel control signal PCS is at logic low at update time UT_0, transitions to logic high at update time UT_A_QV, and transitions to logic low at update time UT_BV and remains at logic low for the rest of frame update period FT. Thus pixel control signal PCS of FIG. 11B achieves the same results as illustrated in FIGS. 3-5 (in particular see pixel control signal PCS_R(1,1) by adding the quantized value QV (which is negative in FIG. 11B) of a sharpener pixel from the color component of a base pixel. If global input signal GI as shown in FIGS. 9A and 9B had been used in place of inverted base image signal !B_CS the resulting pixel control signal PCS would be at logic low at update time UT_0, transitions to logic high at update time UT_GT, and transitions to logic low at update time UT_BV and remains at logic low for the rest of frame update period FT, which would have more time at logic high than desired because update time UT_GT would be earlier than update time UT_BV; therefore showing the additional range of UT_A_QV of a base bit controlled correction range.

Figure 12:
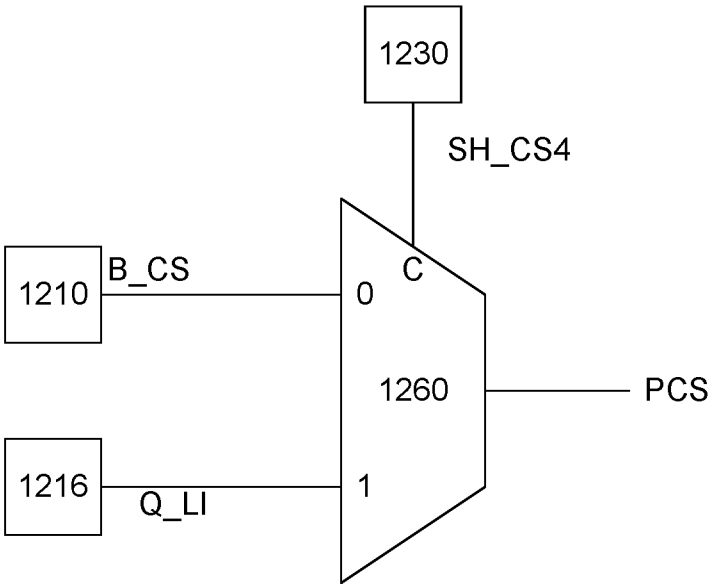
FIG. 12 is a schematic diagram of a novel system to generate pixel control signals in accordance with one embodiment of the present invention.

FIG. 12 shows another embodiment of the present invention, in which an inverted quantized local memory cell 1216 is used to generate a quantized local input signal Q_LI, in place of global input signal GI (FIGS. 8, 9A, and 9B) or inverted base image control signal !B_CS (FIGS. 10, 11A, 11B, and 11C). FIG. 12 also includes a base image memory cell 1210 that generates a base image control signal B_CS, a sharpener image memory cell 1230 that generates a sharpener image control signal SH_CS4, and a multiplexer 1260 that outputs pixel control signal PCS. Base image memory cell 1210 is controlled in the same manner as described above with respect to base image memory cell 615, 810 or 1010 to generate base image control signal B_CS. For brevity the description is not repeated. Similarly, sharpener image memory cell 1230 is controlled in a similar manner as described above with respect to sharpener image memory cell 1030 to generate sharpener image control signal SH_CS4. For brevity the description is not repeated. In FIG. 12, inverted quantized local input memory cell 1216 generates a quantized local input signal Q_LI, which is applied to the logic low input terminal of multiplexer 1260. Like the base image memory cells (610, 810, 1010, and 1210), local input memory cell 1216 is shared by the base block of pixels, which reduces the number of processor meta-actions required to operate the memory cell. In contrast, to inverted base image control signal !B_CS, inverted quantized base memory cell only changes at certain fixed update times (which is similar to the way quantized values for the sharpener image memory cells are used). In a particular embodiment of the present invention, inverted quantized base memory cell uses several of the same quantized values as the sharpener image memory cell 625 to align the switching times of quantized local input signal Q_LI to sharpener image control signal SH_CS4 update times. However other embodiments of the present invention may use different quantize values.

In general, quantized local input signal Q_LI will begin at logic low and remain low for a predetermined minimum time and transition to logic high at update time UT_Q_LV during frame update period FT. Update time UT_Q_LV is selected based on the base value or a predetermined maximum time at which UT_Q_LV is driven high. Generally, maximizing image quality is achieved in this situation by minimizing possible errors from combining the base values and sharpener values during the generation of the pixel control signals. By forcing Q_LI to be low for a defined time and high at a defined time, the smaller sharpener values (which are susceptible to higher visual scrutiny) will be rendered in an ideal manner. Update time UT_Q_LV (when quantized local input signal Q_LI transitions to logic high) is generally close to the update time UT_BV (the update time when base control signal B_CS transitions to logic low) but may precede or follow update time UT_BV.

The embodiment of FIG. 6B and the embodiment of FIG. 12 are each shown with 3 memory cells. However, quantized local input memory cell 1216 of the embodiment of FIG. 12 is shared by all the pixels of the block. In contrast, inverted sharpener sign bit memory cell 635 exists for each pixel of the block. Thus displays using the embodiment of FIG. 12 uses less memory cells overall than displays using the embodiment of FIG. 6B.

Figure 13A:
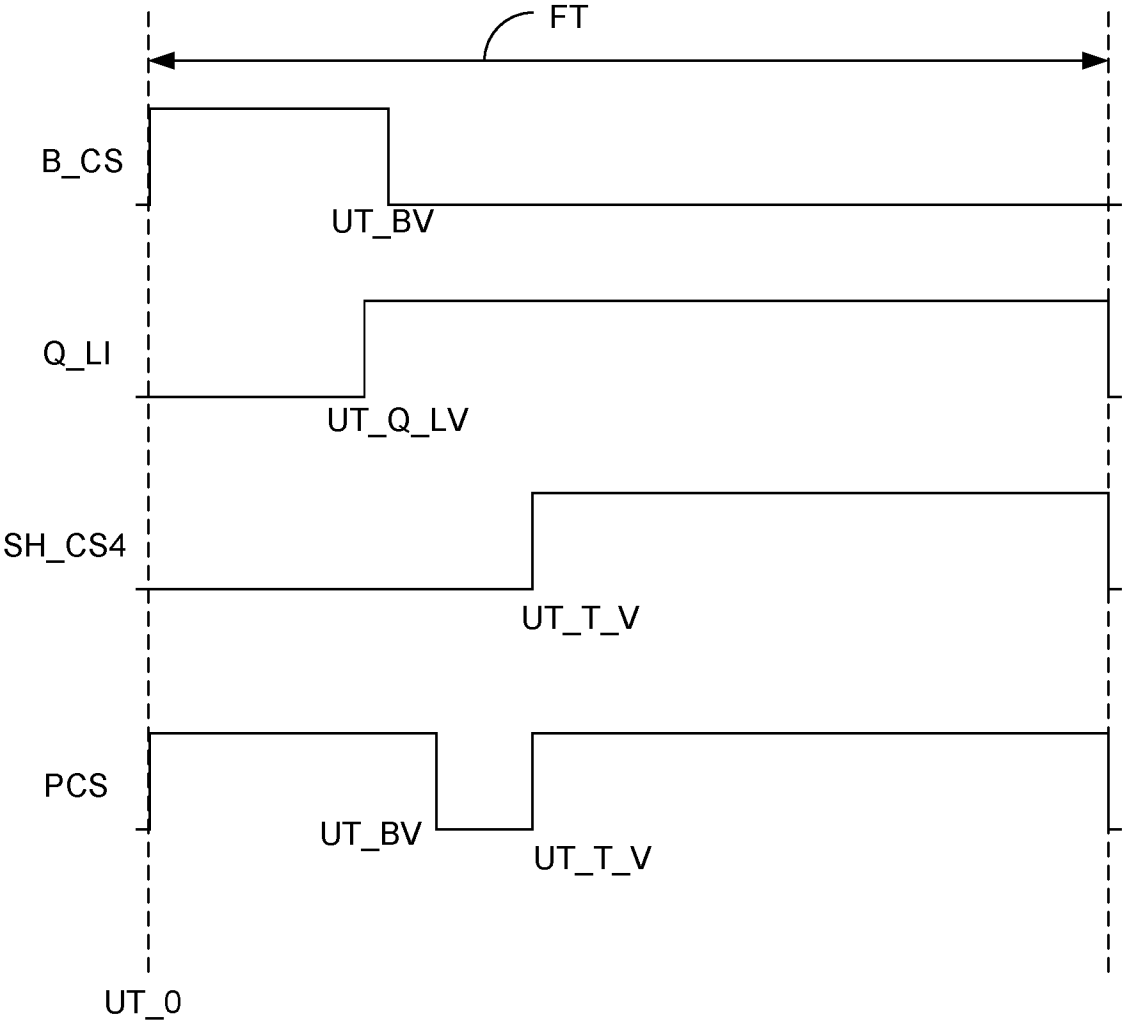
FIGS. 13A-13B shows signals of a novel system to generate pixel control signals in accordance with an embodiment of the present invention.
Figure 13B:
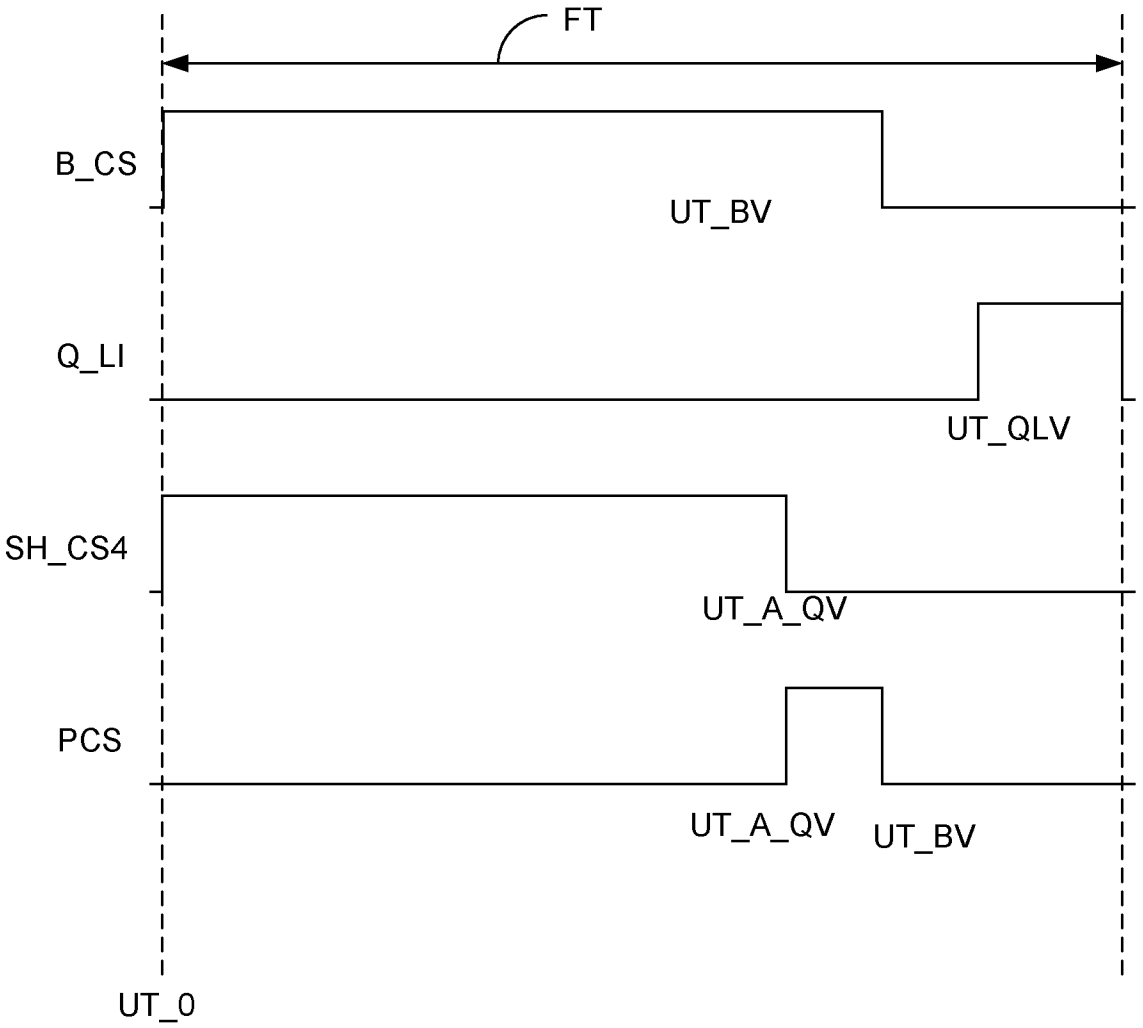

FIGS. 13A and 13B illustrate operation of the embodiment of FIG. 12. FIG. 13A illustrates the signals when quantized value QV of sharpener pixel S_P(X, Y) is positive. As explained above, base image memory cell 1210 outputs base image control signal B_CS which is driven to logic high at update time UT_0 and transitions to logic low at update time UT_BV, where base value BV is the value of color component B_C(int(X/2), int(Y/2)) of a pixel B_P(int(X/2), int(Y/2)) of base image B (as explained above). Quantized local input signal Q_LI is at logic low at update time UT_0 and transitions to logic high at update time UT_Q_LI. As explained above, quantized local input signal Q_LI only transitions at pre-selected quantized value and thus the transition of quantized local input signal Q_LI is selected to match the desired correction range for sharpener pixels S_P(X, Y) associated with color component B_C(int(X/2), int(Y/2)). Sharpener image memory cell 1230 outputs sharpener control signal SH_CS4. For FIG. 13A, quantized value QV of sharpener pixel S_P(X, Y) is positive therefore sharpener control signal SH_CS4 starts at logic low at update time UT_0, and transitions to logic high at update time UT_T_V, where transition value T_V is equal to 255 minus quantized value QV of sharpener pixel S_P(X, Y). Sharpener image control signal SH_CS4 controls Multiplexer 1260, which drives pixel control signal PCS. When sharpener image control signal SH_CS4 is at logic low, multiplexer 1260 outputs a copy of base image control signal B_CS as pixel control signal PCS. However, when sharpener image control signal SH_CS4 is at logic high, multiplexer 1260 outputs a copy of quantized local input signal Q_LI as pixel control signal PCS. Consequently pixel control signal PCS is at logic high at update time UT_0, transitions to logic low at update time UT_BV, and transitions to logic high at update time UT_T_V and remains at logic high for the rest of frame update period FT. Thus pixel control signal PCS of FIG. 13A achieves the same results as illustrated in FIGS. 3-5 (in particular see pixel control signals PCS_R(1,0) and PCS_R(1,1) of FIG. 5) by adding the quantized value QV of a sharpener pixel to the color component of a base pixel.

FIG. 13B illustrates the signals when quantized value QV of sharpener pixel S_P(X, Y) is negative. As explained above, base image memory cell 1210 outputs base image control signal B_CS which is driven to logic high at update time UT_0 and transitions to logic low at update time UT_BV, where base value BV is the value of color component B_C(int(X/2), int(Y/2)) of a pixel B_P(int(X/2), int(Y/2)) of base image B (as explained above). Quantized local input signal Q_LI is at logic low at update time UT_0 and transitions to logic high at update time UT_Q_LI. As explained above, quantized local input signal Q_LI only transitions at pre-selected quantized value. Sharpener image memory cell 1230 outputs sharpener control signal SH_CS4. For FIG. 13B, quantized value QV of sharpener pixel S_P(X, Y) is negative therefore sharpener control signal SH_CS4 starts at logic high at update time UT_0, and transitions to logic low at update time UT_A_QV, where transition value A_QV is equal to the absolute value of quantized value QV of sharpener pixel S_P(X, Y). Sharpener image control signal SH_CS4 controls Multiplexer 1260, which drives pixel control signal PCS. When sharpener image control signal SH_CS4 is at logic low, multiplexer outputs a copy of base image control signal B_CS as pixel control signal PCS. However, when sharpener image control signal SH_CS4 is at logic high, multiplexer 1260 outputs a copy of inverted quantized local input signal Q_LI as pixel control signal PCS. Consequently, pixel control signal PCS is at logic low at update time UT_0, transitions to logic high at update time UT_A_QV, and transitions to logic low at update time UT_BV and remains at logic low for the rest of frame update period FT. Thus pixel control signal PCS of FIG. 13B achieves the same results as illustrated in FIGS. 3-5 (in particular see pixel control signal PCS_R(1,1) by adding the quantized value QV (which is negative in FIG. 13B) of a sharpener pixel from the color component of a base pixel.

Some embodiments of the present invention improve the results of the embodiments of FIGS. 8, 10 and FIG. 12 by combining the preferred qualities of each into a single embodiment. Due to the hardwired nature of inverted base control signal !B_CS (FIG. 10), small sharpener values (which tend to represent smooth contouring and subtle shading transitions) may not be ideally reproduced when applied to very bright or very dim base values (i.e. when update time UT_BV time is early or late in frame update period FT). This is due to inverted base control signal !B_CS transitioning during these fine tuning adjustment times, which is a result of its direct inversion of base image control signal B_CS. Conversely FIG. 12 corrects this anomaly, but requires inverted quantized local memory cell 1216 be maintained during frame update time, which adds complication to both the driver hardware and scheduling compared to the other embodiments of the present invention.

Figure 14:
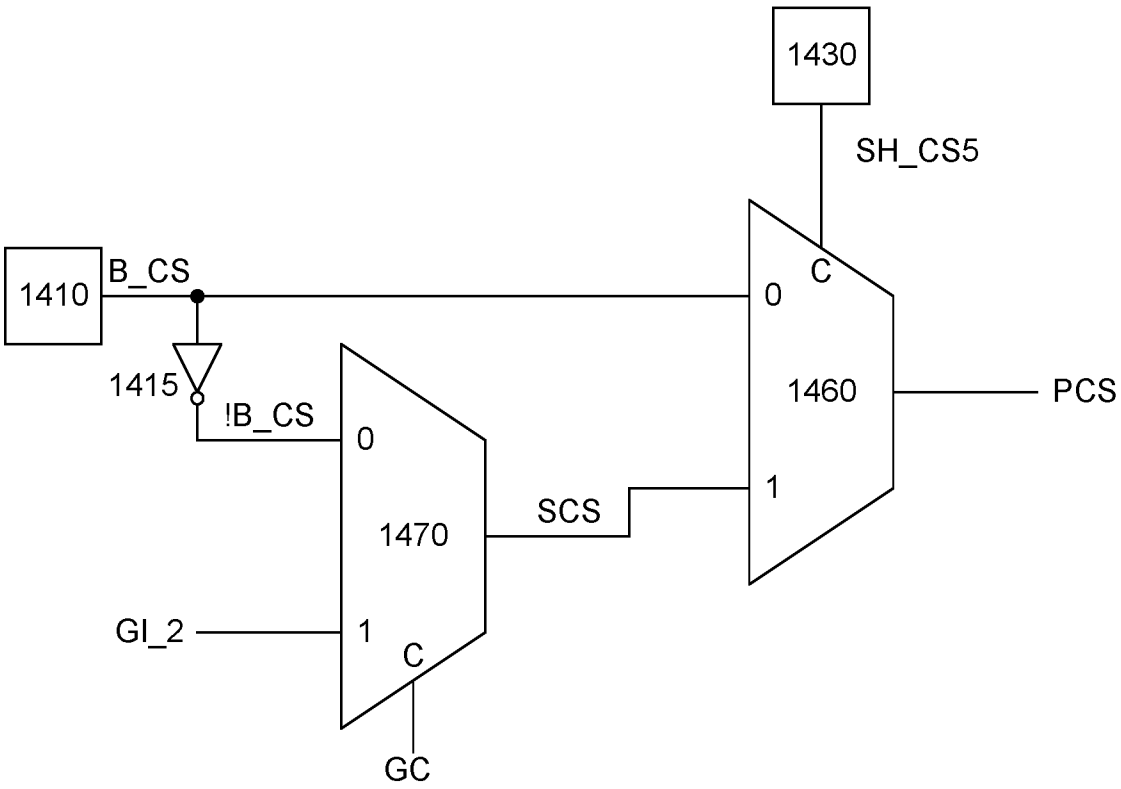
FIG. 14 is a schematic diagram of a novel system to generate pixel control signals in accordance with one embodiment of the present invention

The embodiment of the invention shown in FIG. 14 utilizes the automatic update qualities of the embodiment of FIG. 10 for a sharpener correction signal SCS to better support large sharpener value offsets while supporting ideal reproduction of small fine tuning sharpener correction values like the embodiments of FIGS. 6A, 6B, 8, and 12. FIG. 14 includes a base image memory cell 1410 that generates a base image control signal B_CS, a sharpener image memory cell 1430 that generates a sharpener image control signal SH_CS5, an inverter 1415 that outputs an inverted base control signal !B_CS, a multiplexer 1470 that outputs a sharpener control signal SCS, and a multiplexer 1460 that outputs pixel control signal PCS. Base image memory cell 1410 is controlled in the same manner as described above with respect to base image memory cell 1210 to generate base image control signal B_CS. For brevity the description is not repeated. Similarly, sharpener image memory cell 1430 is controlled in a similar manner as described above with respect to sharpener image memory cell 1230 to generate sharpener image control signal SH_CS5. For large sharpener offsets, the combination of base value BV with quantized value QV of the sharpener pixel should be in the range of 0 to 255+/− an acceptable variance. Some embodiments of the present invention, force this at the time of generating the sharpener value. In other embodiments, the generation of sharpener control signal SH_CS5 is tested against the sharpener value and base value, or just the sharpener when the setting of Global Control signal GC is set to logic high. Additional sharpener compare times can be generated against the sharpener quantized values and base values to further improve image performance. In FIG. 14, base image control signal B_CS is applied to the logic low input terminal of multiplexer 1460 and to an input terminal of inverter 1415 which outputs the inverted base image control signal !B_CS which is applied to the logic low input terminal of multiplexer 1470. In some embodiments of the present invention base image memory cell 1410 can output inverted base image control signal !B_S directly and inverter 1415 is not used. A global input signal GI_2 is applied to the logic high input terminal of multiplexer 1470. The control of global input signal GI_2 is the same as described previously for global input signal GI. For brevity the description is not repeated. A global control signal GC is applied to the control terminal of multiplexer 1470 and controls which signal is selected on the output terminal of multiplexer 1470 as sharpener correction signal SCS, which is applied to the logic high input terminal of multiplexer 1460.

Conceptually, the embodiment of FIG. 14 combines the features of the embodiment of FIG. 8 and the embodiment of FIG. 10 by allowing pixel control signal PCS to be formed from global input signal GI_2, and inverted base control signal, and the base control signal under the control of global control signal GC and sharpener control signal SH_CS5. First multiplexer 1470 combines global input signal GI_2 and inverted base control signal !B_CS under the control of global control signal GC. One of the issues with the embodiment of FIG. 10, is that if the base value is very large or very small, inverted base control signal !B_CS would transition very early or very late in frame update period FT. Consequently, the ability for sharpening control signal SH_CS3 (of FIG. 10) to adjust pixel control signal PCS would be limited. The embodiment of FIG. 14 controls sharpener control signal so that the transition of sharpener control signal SCS from logic low to logic high is between a sharpening min update time UT_SCS_Min and a sharpening max update time UT_SCS_Max. Specifically, if inverted base control signal !B_CS transitions from logic low to logic high before sharpening min update time UT_SCS_Min, then sharpening correction signal SCS transitions from logic low to logic high at sharpening min update time UT_SCS_Min. If inverted base control signal !B_CS transitions from logic low to logic high after sharpening max update time UT_SCS_Max, then sharpening correction signal SCS transitions from logic low to logic high at sharpening max update time UT_SCS_Max. Specifically, if inverted base control signal !B_CS transitions from logic low to logic high in between sharpening min update time UT_SCS_Min and sharpening max update time UT_SCS_Max, then sharpening correction signal SCS transitions from logic low to logic high at the same time inverted base control signal !B_CS transitions. In one embodiment of the present invention, update time SCS_Min is approximately at 25% of the frame update time period and SCS_Max is approximately at 75% of the frame update time period. However other embodiments of the present invention assigns sharpening min update time SCS_MIN and sharpening max update time SCS_Max based on the quantized sharpening values being used.

Figure 15A:
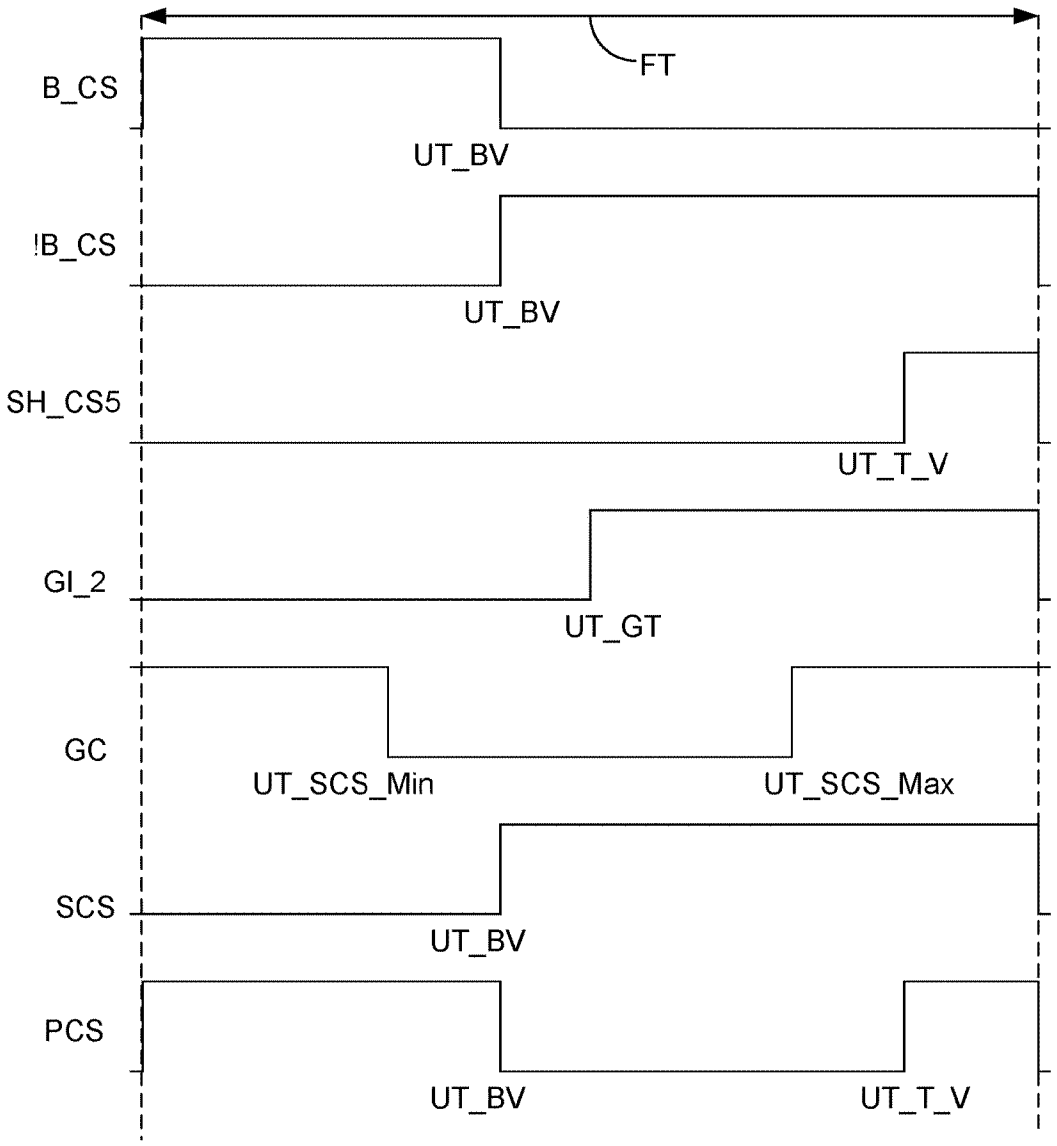
FIGS. 15A-15D shows signals of a novel system to generate pixel control signals in accordance with an embodiment of the present invention.

FIGS. 15A, 15B, 15C, and 15D illustrate operation of the embodiment of FIG. 14. FIG. 15A illustrates the signals when quantized value QV of sharpener pixel S_P(X, Y) is small but positive. As explained above, base image memory cell 1410 outputs base image control signal B_CS which is driven to logic high at update time UT_0 and transitions to logic low at update time UT_BV, where base value BV is the value of color component B_C(int(X/2), int(Y/2)) of a pixel B_P(int(X/2), int(Y/2)) of base image B (as explained above). Global input signal GI_2 is at logic low at update time UT_0 and transitions to logic high at update time UT_GT, where GT is the global transition time. For the embodiment of FIG. 14, the global transition time can be any time between sharpening min update time UT_SCS_Min and sharpening max update time UT_SCS_Max. Sharpener image memory cell 1430 outputs sharpener control signal SH_CS5. For FIG. 15A, quantized value QV of sharpener pixel S_P(X, Y) is positive; therefore, sharpener control signal SH_CS5 starts at logic low at update time UT_0, and transitions to logic high at update time UT_T_V, where transition value T_V is equal to 255 minus quantized value QV of sharpener pixel S_P(X, Y). Global control signal GC controls Multiplexer 1470, which drives sharpener correction signal SCS. When global control signal GC is at logic low, multiplexer 1470 outputs a copy of inverted base image control signal !B_CS as sharpener correction signal SCS. However, when global control signal GC is at logic high, multiplexer 1470 outputs a copy of global input signal GI_2 as sharpener correction signal SCS. In FIG. 15A, global control signal GC begins at logic high and transitions to logic low at sharpening min update time UT_SCS_Min and transitions to logic high at sharpening max update time UT_SCS_Max. Because update time UT_BV is in between sharpening min update time UT_SCS_Min and sharpening max update time UT_SCS_Max, sharpener correction signal SCS transitions at the same time as inverted base control signal !B_CS transitions. Thus, sharpener correction signal SCS begins at logic low and transitions to logic high at update time UT_BV.

Sharpener control signal SH_CS5 controls Multiplexer 1460, which drives pixel control signal PCS. When sharpener control signal SH_CS5 is at logic low, multiplexer 1460 outputs a copy of base image control signal B_CS as pixel control signal PCS. However, when sharpener image control signal SH_CS5 is at logic high, multiplexer 1460 outputs a copy of sharpener correction signal SCS as pixel control signal PCS. Consequently, pixel control signal PCS is at logic high at update time UT_0, transitions to logic low at update time UT_BV, and transitions to logic high at update time UT_T_V and remains at logic high for the rest of frame update period FT. Thus pixel control signal PCS of FIG. 15A achieves the same results as illustrated in FIGS. 3-5 (in particular see pixel control signals PCS_R(1,0) and PCS_R (1,1) of FIG. 5) by adding the quantized value QV of a sharpener pixel to the color component of a base pixel.

Figure 15B:
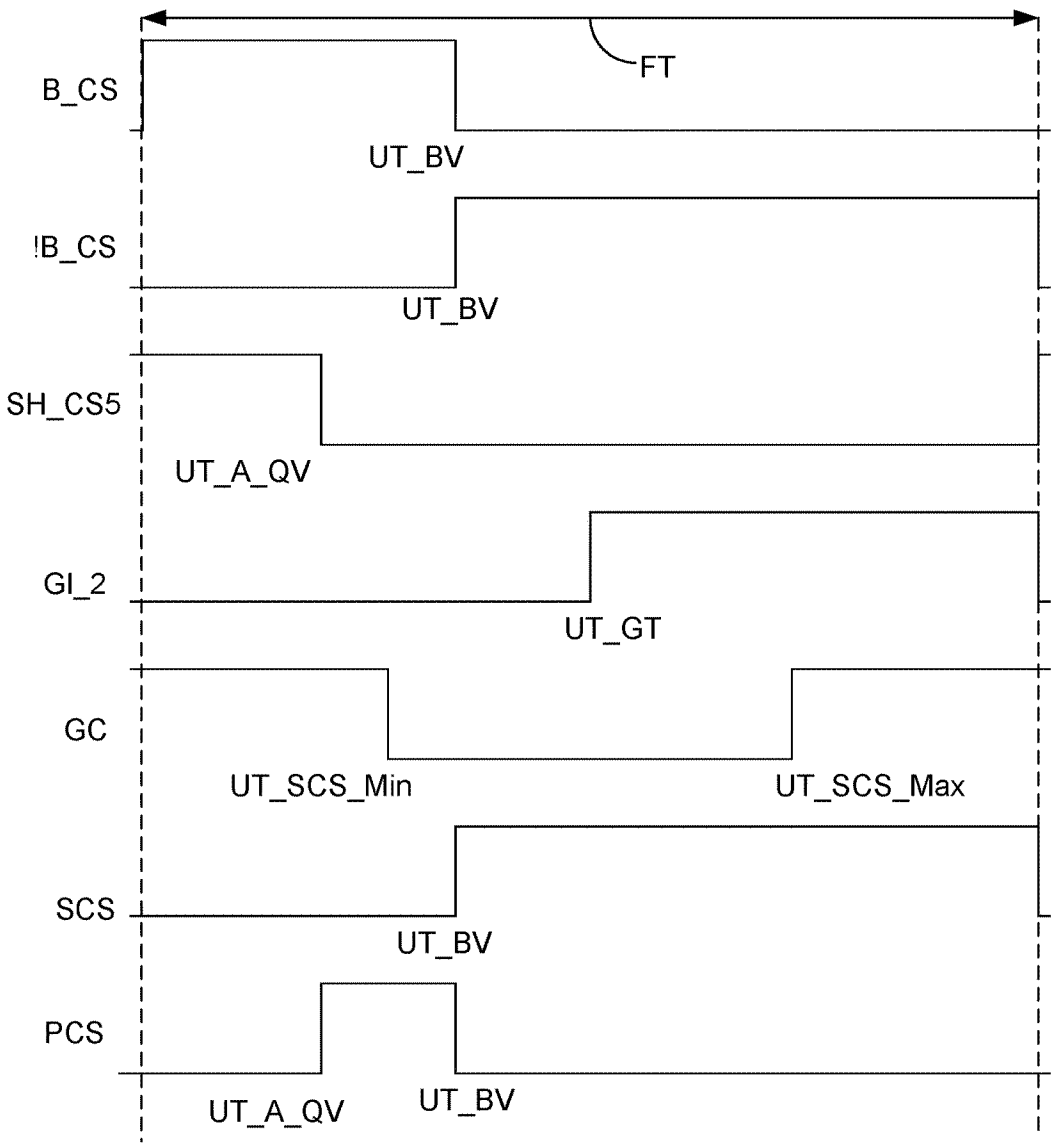

FIG. 15B illustrates the signals when quantized value QV of sharpener pixel S_P(X, Y) is small but negative. As explained above, base image memory cell 1410 outputs base image control signal B_CS which is driven to logic high at update time UT_0 and transitions to logic low at update time UT_BV, where base value BV is the value of color component B_C(int(X/2), int(Y/2)) of a pixel B_P(int(X/2), int(Y/2)) of base image B (as explained above). Global input signal GI is at logic low at update tome UT_0 and transitions to logic high at update time UT_GT, where GT is the global transition time. Sharpener image memory cell 1430 outputs sharpener control signal SH_CS5. For FIG. 15B, quantized value QV of sharpener pixel S_P(X, Y) is negative; therefore, sharpener control signal SH_CS5 starts at logic high at update time UT_0, and transitions to logic low at update time UT_A_QV, where transition value A_QV is equal to the absolute value of quantized value QV of sharpener pixel S_P(X, Y). Global control signal GC controls Multiplexer 1470, which drives sharpener correction signal SCS. When global control signal GC is at logic low, multiplexer 1470 outputs a copy of inverted base image control signal !B_CS as sharpener correction signal SCS. However, when global control signal GC is at logic high, multiplexer 1470 outputs a copy of global input signal GI as sharpener correction signal SCS. Global control signal GC begins at logic high and transitions to logic low at sharpening min update time UT_SCS_Min and transitions to logic high at sharpening max update time UT_SCS_Max. Because update time UT_BV is in between sharpening min update time UT_SCS_Min and sharpening max update time UT_SCS_Max, sharpener correction signal SCS transitions at the same time as inverted base control signal !B_CS transitions. Thus, sharpener correction signal SCS begins at logic low and transitions to logic high at update time UT_BV.

Sharpener image control signal SH_CS5 controls Multiplexer 1460, which drives pixel control signal PCS. When sharpener image control signal SH_CS5 is at logic low, multiplexer outputs a copy of base image control signal B_CS as pixel control signal PCS. However, when sharpener image control signal SH_CS5 is at logic high, multiplexer 1460 outputs a copy of sharpener correction signal SCS as pixel control signal PCS. Consequently pixel control signal PCS is at logic low at update time UT_0, transitions to logic high at update time UT_A_QV, and transitions to logic low at update time UT_BV and remains at logic low for the rest of frame update period FT. Thus pixel control signal PCS of FIG. 15B achieves the same results as illustrated in FIGS. 3-5 (in particular see pixel control signal PCS_R(0,1) of FIG. 5) by adding the quantized value QV (which is negative in FIG. 15*b*) of a sharpener pixel to the color component of a base pixel.

Figure 15C:
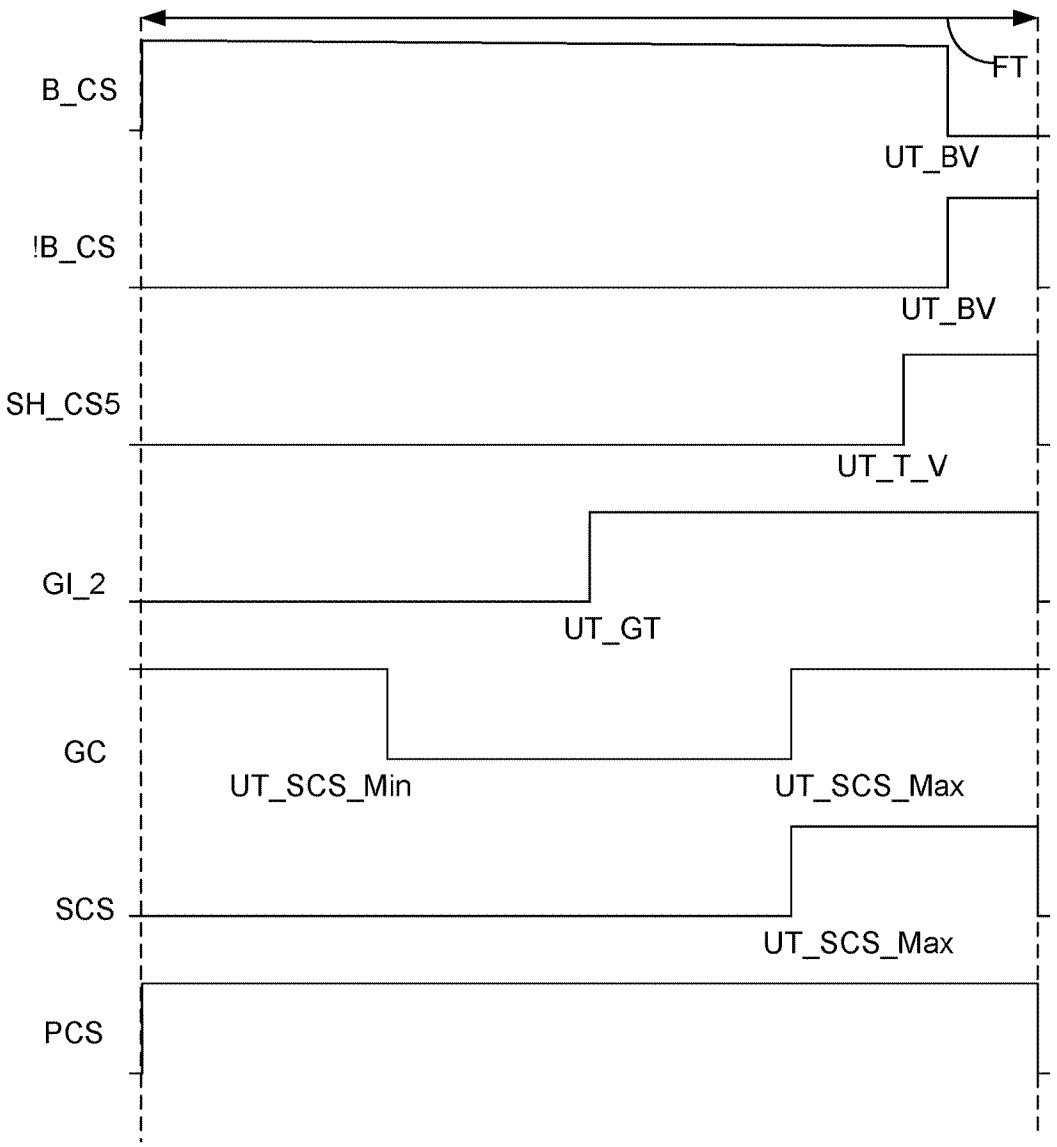

FIG. 15C is similar to FIG. 15A except that the base value is very large thus update time UT_BV is greater than sharpening max update time UT_SCS_Max. Additionally, the base value plus the sharpener value is larger than 255. For brevity only the changes between FIGS. 15C and 15A are described in detail. Base image control signal B_CS is driven to logic high at update time UT_0 and transitions to logic low at update time UT_BV, which as shown in FIG. 15C, is after sharpening max update time UT_SCS_Max. Inverted base image control signal !B_CS is at logic low at update time UT_0 and transitions to logic high at update time UT_BV. Sharpener control signal SH_CS5 starts at logic low at update time UT_0, and transitions to logic high at update time UT_T_V. Global input signal GI_2 is at logic low at update time UT_0 and transitions to logic high at update time UT_GT. Global control signal GC begins at logic high and transitions to logic low at sharpening min update time UT_SCS_Min and transitions to logic high at sharpening max update time UT_SCS_Max. As explained above, the embodiment of FIG. 14 causes only allows sharpening control signal to transition to logic high in between sharpening min update time UT_SCS_Min and at sharpening max update time UT_SCS_Max (inclusive). Therefore, in FIG. 15C, sharpener correction signal SCS begins at logic low and transitions to logic high at sharpening max update time UT_SCS_Max. Sharpener control signal SH_CS5 controls Multiplexer 1460, which drives pixel control signal PCS. When sharpener control signal SH_CS5 is at logic low, multiplexer 1460 outputs a copy of base image control signal B_CS as pixel control signal PCS. However, when sharpener image control signal SH_CS5 is at logic high, multiplexer 1460 outputs a copy of sharpener correction signal SCS as pixel control signal PCS. Consequently in FIG. 15C, pixel control signal PCS is at logic high at update time UT_0, and remains at logic high for the rest of frame update period FT. If the embodiment of FIG. 10 were used instead of the embodiment of FIG. 14, and the timing allowed by SH_CS5 were substituted into SH_CS3, then pixel control signal PCS would have erroneously transitioned to logic low at update time UT_T_V and then transitioned to logic high at time UT_BV due to an overflow error. However, by using sharpening correction signal SCS instead of just inverted base control signal !B_CS this type of overflow error can be handled by the embodiment of FIG. 14 without checking the base value. In other words, for sharpener additions with a value less than 255-UT_SCS_Max, the sharpener value alone is sufficient to determine the switching time of sharpener control signal SH_CS5.

Figure 15D:
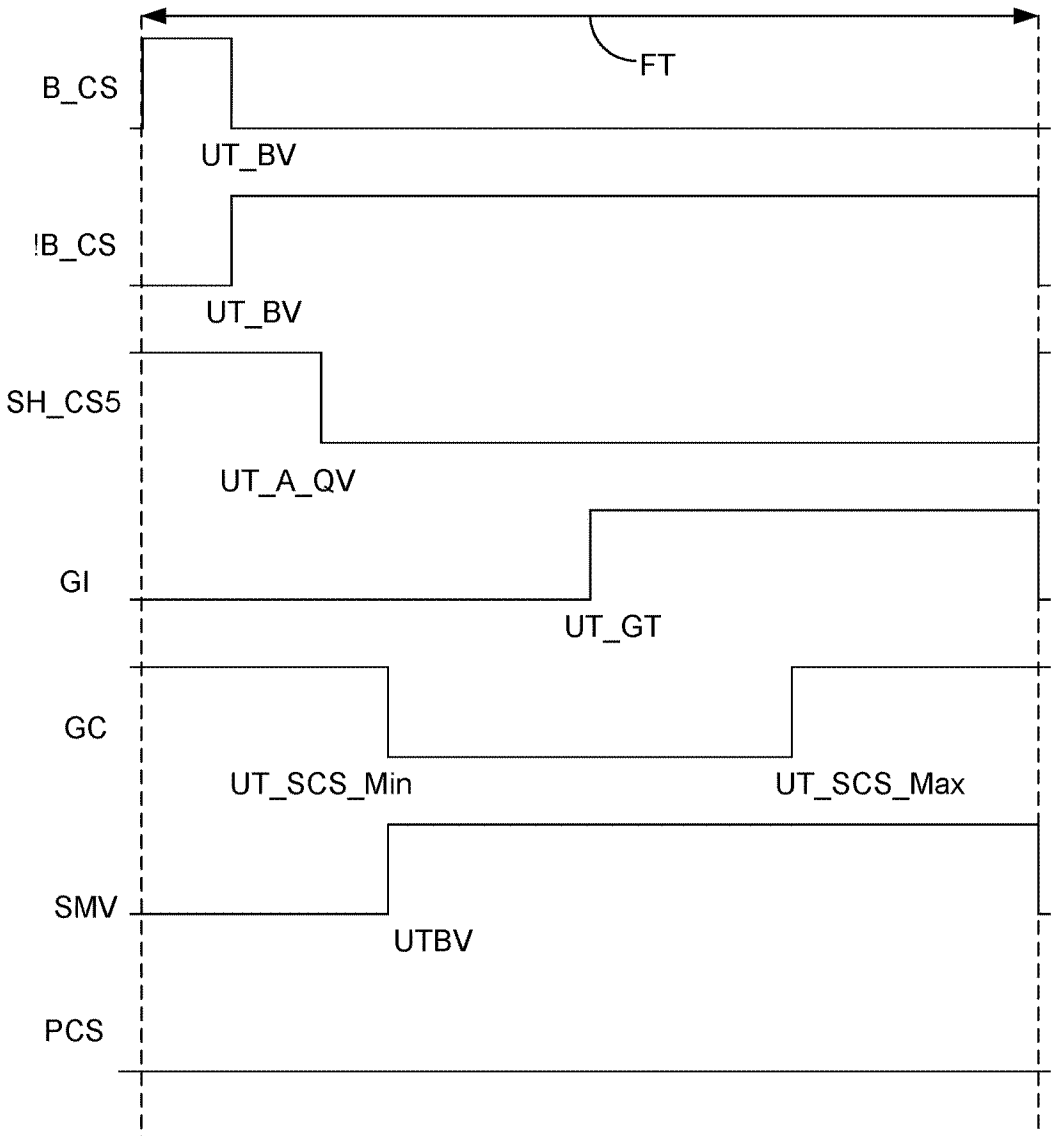

FIG. 15D is similar to FIG. 15B except that the base value is very small thus update time UT_BV is less than sharpening min update time UT_SCS_Min. Additionally, the base value minus the absolute sharpener value is less than 0. For brevity only the changes between FIGS. 15D and 15B are described in detail. Base image control signal B_CS is driven to logic high at update time UT_0 and transitions to logic low at update time UT_BV, which as shown in FIG. 15D, is before sharpening min update time UT_SCS_Min. Inverted base image control signal !B_CS is at logic low at update time UT_0 and transitions to logic high at update time UT_BV. Sharpener control signal SH_CS5 starts at logic high at update time UT_0, and transitions to logic low at update time UT_A_QV. Global input signal GI_2 is at logic low at update time UT_0 and transitions to logic high at update time UT_GT. Global control signal GC begins at logic high and transitions to logic low at sharpening min update time UT_SCS_Min and transitions to logic high at sharpening max update time UT_SCS_Max. As explained above, the embodiment of FIG. 14 causes only allows sharpening control signal to transition to logic high in between sharpening min update time UT_SCS_Min and at sharpening max update time UT_SCS_Max (inclusive). Therefore, in FIG. 15D, sharpener correction signal SCS begins at logic low and transitions to logic high at sharpening min update time UT_SCS_Min. Sharpener control signal SH_CS5 controls Multiplexer 1460, which drives pixel control signal PCS. When sharpener control signal SH_CS5 is at logic low, multiplexer 1460 outputs a copy of base image control signal B_CS as pixel control signal PCS. However, when sharpener image control signal SH_CS5 is at logic high, multiplexer 1460 outputs a copy of sharpener correction signal SCS as pixel control signal PCS. Consequently in FIG. 15D, pixel control signal PCS is at logic low at update time UT_0, and remains at logic low for the rest of frame update period FT. If the embodiment of FIG. 10 were used instead of the embodiment of FIG. 14, and the timing allowed by SH_CS5 were substituted into SH_CS3, then pixel control signal PCS would have erroneously transitioned to logic high at update time UT_BV and then transitioned to logic low at update time UT_A_QV due to an underflow error. However, by using sharpening correction signal SCS instead of just inverted base control signal !B_CS this type of underflow error can be handled by the embodiment of FIG. 14 without checking the base value. In other words, for sharpener subtractions with a value less than UT_SCS_Min, the sharpener value alone is sufficient to determine the switching time of sharpener control signal SH_CS5.

As indicated above, overflow (when the base value plus the sharpener value is greater than 255) and underflow (when the base value minus the sharpener value is negative) conditions may cause errors that degrade image quality. Some embodiments of the present invention take proactive steps to minimize these errors. Generally there are two main types of overflow conditions that are of concern. In the first type of overflow condition the sharpener value is large; in the second type of overflow condition the sharpener value is small. The Prior Art which contains a single memory bit is susceptible to both types of overflow conditions. To correct for overflow conditions and under all conditions, systems based on Prior Art must measure the base value along with the sharpener value to determine the transition times of pixel control signal PCS. Embodiments of the present invention based on FIG. 6A or 6B are not susceptible to overflow conditions. Embodiments of the present invention based on FIG. 8, as explained above should not have large sharpener values, as determined by the GI signal, and would not be subject to the type 1 overflow condition. Furthermore, embodiments based on FIG. 8 do not have issues with type 2 overflow conditions. Embodiments of the present invention based on FIG. 10 are susceptible to both types of overflow conditions. To minimize errors for overflow conditions, embodiments based on FIG. 10 can detect when the overflow condition can occur and may modify the sharpener value so that sharpener control signal SH_CS3 can transition solely according to a sharpener value that reduces or eliminates the error. One method for these conditions is to always measure the base value along with the sharpener value to determine the a good transition time of sharpener control signal SH_CS3; with this method good image control can be obtained by adding instruction times in excess of number of unique quantized values. Embodiments of the present invention based on FIG. 12 are not susceptible to type 2 overflow conditions. But to minimize errors for the type 1 overflow condition, embodiments based on FIG. 12 can detect when the overflow condition can occur and may modify the sharpener value so that sharpener control signal SH_CS4 transitions solely according to a sharpener value that reduces or eliminates the overflow condition. One method for these conditions is to measure the base value along with the sharpener value to determine the a good transition time of sharpener control signal SH_CS4; with this method good image control can be obtained by adding instruction times in excess of number of unique quantized values. Embodiments of the present invention based on FIG. 14 are not susceptible to type 2 overflow conditions. But to minimize errors for the type 1 overflow condition, embodiments based on FIG. 14 can detect when the overflow condition can occur and may modify the sharpener value so that sharpener control signal SH_CS5 transitions solely according to a sharpener value that reduces or eliminates the error. One method for these conditions is to measure the base value along with the sharpener value to determine the a good transition time of sharpener control signal SH_CS5; with this method much better image control can be obtained by adding instruction times in excess of number of unique quantized values.

Generally there are two main types of underflow conditions that are of concern. In the first type of underflow condition the magnitude of the sharpener value is large; in the second type of underflow condition the magnitude of the sharpener value is small. The Prior Art which contains a single memory bit is susceptible to both types of underflow conditions. To correct for underflow conditions and under all conditions, embodiments based on Prior Art must measure the base value along with the sharpener value to determine the transition time of pixel control signal PCS. Embodiments of the present invention based on FIG. 6A or 6B are not susceptible to underflow conditions. Embodiments of the present invention based on FIG. 8, as explained above should not have large sharpener magnitude values, as determined by the GI signal, and would not be subject to the type 1 underflow condition. Furthermore, embodiments based on FIG. 8 do not have issues with type 2 underflow conditions. Embodiments of the present invention based on FIG. 10 are susceptible to both types of underflow conditions. To minimize errors for underflow conditions, embodiments based on FIG. 10 can detect when the underflow condition can occur and may modify the sharpener value so that sharpener control signal SH_CS3 can transition solely according to a sharpener value that reduces or eliminates the error. One method for these conditions is to always measure the base value along with the sharpener value to determine the a good transition time of sharpener control signal SH_CS3; with this method good image control can be obtained by adding instruction times in excess of number of unique quantized values. Embodiments of the present invention based on FIG. 12 are not susceptible to type 2 underflow conditions. But to minimize errors for the type 1 underflow condition, embodiments based on FIG. 12 can detect when the underflow condition can occur and may modify the sharpener value so that sharpener control signal SH_CS4 transitions solely according to a sharpener value that reduces or eliminates the error. One method for these conditions is to measure the base value along with the sharpener value to determine the a good transition time of sharpener control signal SH_CS4; with this method good image control can be obtained by adding instruction times in excess of number of unique quantized values. Embodiments of the present invention based on FIG. 14 are not susceptible to type 2 underflow conditions. But to minimize errors for the type 1 underflow condition, embodiments based on FIG. 14 can detect when the underflow condition can occur and may modify the sharpener value so that sharpener control signal SH_CS5 transitions solely according to a sharpener value that reduces or eliminates the error. One method for these conditions is to measure the base value along with the sharpener value to determine the a good transition time of sharpener control signal SH_CS5; with this method good image control can be obtained by adding instruction times in excess of number of unique quantized values.

In the various embodiments of the present invention, novel structures and methods have been described for generating a pixel control signals. The various embodiments of the structures and methods of this invention that are described above are illustrative only of the principles of this invention and are not intended to limit the scope of the invention to the particular embodiment described. For example, in view of this disclosure those skilled in the art can define other update times, global input signals, global control signals, sharpener control signals, base control signals, pixel control signals, field time periods, control signals, base images, sharpener images, color components, light modulating units, gamma corrections and so forth, and use these alternative features to create a method or system according to the principles of this invention. Thus, the invention is limited only by the following claims.

What is claimed is:

1. A method to generate a plurality of pixel control signals for a first block of pixels having a first first-block pixel and a second first-block pixel and a second block of pixels having a first second-block pixel and a second second-block pixel, the method comprising:

generating a first-block base control signal that is shared by the first block of pixels;

generating a first first-block sharpening control signal for the first first-block pixel;

generating a first first-block pixel control signal using the first first-block sharpening control signal and the first-block base control signal;

generating a second-block base control signal that is shared by the second block of pixels;

generating a first second-block sharpening control signal for the first second-block pixel; and generating a first second-block pixel control signal using the first second-block sharpening control signal and the second-block base control signal.

2. The method of claim 1 further comprising generating a second first-block sharpening control signal for the second first-block pixel; generating a second first-block pixel control signal using the second first-block sharpening control signal and the first-block base control signal; generating a second second-block sharpening control signal for the second second-block pixel; and generating a second second-block pixel control signal using the second second-block sharpening control signal and the second-block base control signal, generating a second pixel control signal using the second sharpening control signal and the base control signal.

3. The method of claim 1, wherein the generating a first first-block pixel control signal using the first first-block sharpening control signal and the first-block base control signal further comprises:

generating a first first-block sharpener sign bit signal;

combining the first first-block sharpener control signal with the first-block base control signal to form a first first-block logic OR signal;

combining the first first-block sharpener control signal with the first-block base control signal to form a first first-block logic AND signal.

4. The method of claim 3, wherein the generating a first first-block pixel control signal using the first first-block sharpening control signal and the first-block base control signal further comprises:

selecting the first-block first logic OR signal as the first first-block pixel control signal when the first first-block sharpener sign bit signal is in a first logic state; and selecting the first first-block logic AND signal as the first first-block pixel control signal when the first first-block sharpener sign bit signal is in a second logic state.

5. The method of claim 1, wherein the first-block base control signal begins a field time period at logic high and transitions to logic low at a base value update time; and wherein the first-block first sharpener control signal begins the field time period at logic low and transitions to logic high at a transition value update time that is a first first-block sharpener value from an end of the field time period.

6. The method of claim 5, wherein the first first-block pixel control signal begins the field time period at logic high, transitions to logic low at the first-block base value update time, and transitions to logic high at the transition value update time that is the first first-block sharpener value from the end of the field update time.

7. The method of claim 1, wherein the first-block base control signal begins a field time period at logic high and transitions to logic low at a first-block base value update time; and wherein the first first-block sharpener control signal begins the field time period at logic low and transitions to logic high at a transition value update time that is at the absolute value of a first first-block sharpener value from a start of the field time period.

8. The method of claim 7, wherein the first first-block pixel control signal begins the field time period at logic low, transitions to logic high at the transition value update time that is at the absolute value of the first first-block sharpener value from the start of the field time period, and transitions to logic low at the first-block base value update time.

9. The method of claim 1, wherein the generating a first first-block pixel control signal using the first first-block sharpening control signal and the first-block base control signal further comprises:

generating a first first-block inverted sharpener sign bit signal;

selecting the first-block base control signal as the first pixel control signal when the first first-block sharpener control signal is in a first logic state; and selecting the first first-block inverted sharpener sign bit signal as the first pixel control signal when the first first-block sharpener control signal is in a second logic state.

10. The method of claim 9, wherein the first-block base control signal begins a field time period at logic high and transitions to logic low at a first-block base value update time; and wherein the first first-block sharpener control signal begins the field time period at logic high and transitions to logic low at a transition value update time that is at the absolute value of a first first-block sharpener value from a start of the field time period.

11. The method of claim 10, wherein the first first-block pixel control signal begins the field time period at logic low, transitions to logic high at the transition value update time that is at the absolute value of the first first-block sharpener value from the start of the field time period, and transitions to logic low at the first-block base value update time.

12. The method of claim 1, further comprising:

generating a global input signal; and wherein the generating a first first-block pixel control signal using the first first-block sharpening control signal and the first-block base control signal further comprises:

selecting the first-block base control signal as the first first-block pixel control signal when the first first-block sharpener control signal is in a first logic state; and selecting the global input signal as the first first-block pixel control signal when the first first-block sharpener control signal is in a second logic state.

13. The method of claim 12, wherein the generating a first second-block pixel control signal using the first second-block sharpening control signal and the second-block base control signal further comprises:

selecting the second-block base control signal as the first second-block pixel control signal when the first second-block sharpener control signal is in a first logic state; and selecting the global input signal as the first second-block pixel control signal when the first second-block sharpener control signal is in a second logic state.

14. The method of claim 13, wherein the global input signal begins the field time period at logic low and transitions to logic high at a global transition time;

wherein the first-block base control signal begins a field time period at logic high and transitions to logic low at a first-block base value update time; and wherein the second-block base control signal begins a field time period at logic high and transitions to logic low at a second-block base value update time.

15. The method of claim 14, wherein the global transition time is near the middle of the frame update period.

16. The method of claim 1, wherein the generating a first first-block pixel control signal using the first first-block sharpening signal and the first-block base control signal further comprises:

generating an inverted first-block base control signal;

selecting the first-block base control signal as the first first-block pixel control signal when the first first-block sharpener control signal is in a first logic state; and selecting the inverted first-block base control signal as the first first-block pixel control signal when the first first-block sharpener control signal is in a second logic state.

17. The method of claim 1, wherein the generating a first first-block pixel control signal using the first first-block sharpening signal and the first-block base control signal further comprises:

generating a first-block quantized local input signal;

selecting the first-block base control signal as the first first-block pixel control signal when the first first-block sharpener control signal is in a first logic state; and selecting the first-block quantized local input signal as the first first-block pixel control signal when the first first-block sharpener control signal is in a second logic state.

18. The method of claim 1, further comprising generating a global input signal;

generating a global control signal; and wherein the generating a first first-block pixel control signal using the first first-block sharpening control signal and the first-block base control signal further comprises:

generating an inverted first-block base control signal;

generating a first first-block sharpener correction signal by selecting the inverted first-block base control signal as the first first-block sharpener correction signal when the global control signal is in a first logic state; and selecting the global input signal as the first first-block sharpener control signal when the global control signal is in a second logic state;

selecting the first-block base control signal as the first first-block pixel control signal when the first first-block sharpener control signal is in the first logic state; and selecting the first first-block sharpener correction signal as the first first-block pixel control signal when the first first-block sharpener control signal is in the second logic state.

19. The method of claim 18, wherein the first-block base control signal begins a field time period at logic high and transitions to logic low at a first-block base value update time;

wherein the global input signal begins the field time period at logic low and transitions to logic high at a global transition time; and wherein the global control signal begins the field time period at logic high and transitions to logic low at a sharpening min update time and transitions to logic high at a sharpening max update time.

20. The method of claim 19, wherein the global transition time is between the sharpening min update time and the sharpening max update time.

* * * * *